US012122576B2

(12) United States Patent
Shao

(10) Patent No.: US 12,122,576 B2
(45) Date of Patent: Oct. 22, 2024

(54) CONTAINER CAPABLE OF BEING QUICKLY OPENED

(71) Applicant: Hui Shao, Guangdong (CN)

(72) Inventor: Hui Shao, Guangdong (CN)

( * ) Notice: Subject to any disclaimer, the term of this patent is extended or adjusted under 35 U.S.C. 154(b) by 150 days.

(21) Appl. No.: 17/780,997

(22) PCT Filed: Aug. 27, 2020

(86) PCT No.: PCT/CN2020/111820
§ 371 (c)(1),
(2) Date: May 30, 2022

(87) PCT Pub. No.: WO2021/109637
PCT Pub. Date: Jun. 10, 2021

(65) Prior Publication Data

US 2022/0411145 A1 Dec. 29, 2022

(30) Foreign Application Priority Data

Dec. 5, 2019 (CN) ..... 201911234136.8
May 21, 2020 (CN) ..... 202010437997.2

(51) Int. Cl.
*B65D 53/02* (2006.01)
*B65D 47/08* (2006.01)
*B65D 51/16* (2006.01)

(52) U.S. Cl.
CPC ..... *B65D 53/02* (2013.01); *B65D 47/0804* (2013.01); *B65D 51/1672* (2013.01); *B65D 2205/02* (2013.01); *B65D 2251/20* (2013.01)

(58) Field of Classification Search
CPC ..... B65D 53/02; B65D 47/0804; B65D 51/1672; B65D 2205/02; B65D 2251/20
(Continued)

(56) References Cited

U.S. PATENT DOCUMENTS 4,533,068 A * 8/1985 Meierhoefer ..... B05B 11/047 222/189.09
5,161,718 A * 11/1992 Gueret ..... B65D 47/2018 222/549
(Continued)

FOREIGN PATENT DOCUMENTS

CN 204587605 8/2015
CN 105857887 8/2016
(Continued)

OTHER PUBLICATIONS

"International Search Report (Form PCT/ISA/210) of PCT/CN2020/111820," mailed on Nov. 11, 2020, with English translation thereof, pp. 1-6.
(Continued)

*Primary Examiner* — Steven A. Reynolds
*Assistant Examiner* — Prince Pal

(57) ABSTRACT

Disclosed is a container capable of being quickly opened. The container comprises a container body and a container cover, wherein a sealing structure used for sealing the container body and the container cover is arranged on the container cover; the sealing structure comprises a base on the lower side of the container cover; an elastic sealing sleeve capable of being bent and deformed is arranged between the base and the container cover; a pulling plate penetrating the container cover is arranged on the upper side of the base; a gland is arranged on the upper side of the container cover; a rotating pin is arranged between the gland and the pulling plate.

16 Claims, 21 Drawing Sheets

(58) Field of Classification Search
USPC ..... 215/235, 216.388, 316; 222/556, 541.5, 222/546, 212, 481.5
See application file for complete search history.

(56) References Cited

U.S. PATENT DOCUMENTS 5,890,517 A * 4/1999 Laible ..... F16L 37/22 137/614.04
8,328,037 B2 * 12/2012 Wu ..... B65D 47/0895 220/717
8,505,188 B2 * 8/2013 Lenz ..... B65D 47/088 264/516
8,622,229 B2 * 1/2014 Lane ..... B65D 43/26 215/388
8,708,203 B2 * 4/2014 Laible ..... B65D 47/122 222/481.5
9,573,738 B1 * 2/2017 Lai ..... B65D 47/305
10,858,158 B2 * 12/2020 Cheng ..... B65D 47/066
11,345,524 B2 * 5/2022 Ni ..... A45F 3/16
11,396,408 B2 * 7/2022 Jinkins ..... B65D 51/18
11,440,706 B2 * 9/2022 Wong ..... B65D 47/063
11,479,390 B1 * 10/2022 Salvador-Zamora ..... B65D 47/0857
2001/0052531 A1 * 12/2001 Randall ..... B65D 47/0809 222/521
2003/0034362 A1 * 2/2003 Blake ..... B05B 9/0883 222/481.5
2004/0134940 A1 * 7/2004 Hearld ..... B65D 47/2018 222/481.5
2004/0155071 A1 * 8/2004 Higgins ..... B65D 47/243 222/481.5
2006/0163189 A1 * 7/2006 Laveault ..... B65D 41/3428 215/349
2008/0179274 A1 * 7/2008 Cheng ..... A45F 3/16 220/238
2009/0218309 A1 * 9/2009 Wang Wu ..... B65D 47/244 215/388
2012/0312832 A1 * 12/2012 Lane ..... B65D 51/242 220/774
2013/0032566 A1 * 2/2013 Lee ..... C02F 1/002 215/388
2015/0375908 A1 * 12/2015 Rognard ..... B65D 47/2031 215/235
2017/0050773 A1 * 2/2017 Rognard ..... B65D 41/3428
2017/0050776 A1 * 2/2017 Roth ..... B65D 53/02
2018/0208366 A1 * 7/2018 Fang ..... A45F 3/18
2018/0319551 A1 * 11/2018 Ferrari ..... B65D 47/242
2019/0183269 A1 * 6/2019 Kalisz ..... A47G 19/2266
2020/0024041 A1 * 1/2020 Niver ..... F01P 11/0238
2020/0391909 A1 * 12/2020 Pinelli ..... B65D 55/10
2021/0086961 A1 * 3/2021 Pinelli ..... B65D 47/0871
2022/0002036 A1 * 1/2022 Li ..... B65D 53/02
2022/0306349 A1 * 9/2022 Hayashi ..... B65D 39/08
2023/0107675 A1 * 4/2023 Wong ..... A47G 19/2272 215/235
2023/0137802 A1 * 5/2023 Zhou ..... B65D 47/0885 215/235
2023/0182970 A1 * 6/2023 Yang ..... B65D 47/123 220/592.2

FOREIGN PATENT DOCUMENTS

| | | |
|---|---|---|
| CN | 205675447 | 11/2016 |
| CN | 109250294 | 1/2019 |
| CN | 208573507 | 3/2019 |
| CN | 208573508 | 3/2019 |
| CN | 209701298 | 11/2019 |
| JP | H11349026 | 12/1999 |
| JP | 2001114329 | 4/2001 |
| JP | 2008100749 | 5/2008 |
| KR | 20130000266 | 1/2013 |

OTHER PUBLICATIONS

"Written Opinion of the International Searching Authority (Form PCT/ISA/237) of PCT/ CN2020/111820," mailed on Nov. 11, 2020, pp. 1-3.

* cited by examiner

CONTAINER CAPABLE OF BEING QUICKLY OPENED

CROSS-REFERENCE TO RELATED APPLICATION

This application is a 371 of international application of PCT application serial no. PCT/CN2020/111820, filed on Aug. 27, 2020, which claims the priority benefit of China application no. 201911234136.8, filed on Dec. 5, 2019 and application no. 202010437997.2, filed on May 21, 2020. The entirety of each of the above mentioned patent applications is hereby incorporated by reference herein and made a part of this specification.

TECHNICAL FIELD

The disclosure relates to a container, and in particular, relates to a container capable of being quickly opened.

DESCRIPTION OF RELATED ART

In the related art, a container is generally connected and sealed by a threaded structure or a clipping structure. Regarding the threaded structure, the thread may be easily damaged after being used for a long period of time, and the connecting and sealing effect is thereby affected. Further, regarding the threaded structure, the sealed container needs to be twisted several times when being opened or closed, so the sealed container cannot be opened and closed quickly. For the clipping structure provided by the related art, a plurality of clips are required to be attached manually to perform connecting and sealing. In the process of use, it is necessary to manually operate a plurality of clips separately, and such an operation process is complicated.

SUMMARY

The disclosure aims to solve the problem of the complicated opening and closing process of a sealed container in the related art, and the disclosure provides a container capable of being quickly opened to achieve quick opening and closing.

The disclosure provides a container capable of being quickly opened is provided, and the container includes a container body and a container cover. A sealing structure used for sealing the container body and the container cover is arranged on the container cover, and the sealing structure includes a base on a lower side of the container cover. An elastic sealing sleeve capable of being bent and deformed is arranged between the base and the container cover. A pulling plate penetrating the container cover is arranged on an upper side of the base. A gland is arranged on an upper side of the container cover, and a rotating pin is arranged between the gland and the pulling plate. When the gland is opened or closed, an axis of the rotating pin moves up and down, and the rotating pin moves the pulling plate up or down. The base fixed on a lower side of the pulling plate moves up and down in an axial direction of the container cover. The elastic sealing sleeve is pressed when the base moves upwards, such that the elastic sealing sleeve expands in a radial direction and is bent outwards to form a sealing ring between an inner wall of the container body and an outer contour of the base, and the sealing ring and an inner side surface of the container body are sealed.

Preferably, at least one rotating pin is provided, the rotating pin includes a pin portion, and the pin portion penetrates a through hole arranged on the gland and a hole arranged on a side surface the pulling plate.

Preferably, the rotating pin includes a V-shaped connecting portion and pin portions at both ends of the V-shaped connecting portion, and each pin portion penetrates the through hole arranged on the gland and the hole arranged on the side surface the pulling plate. A fixed inclined surface is arranged on a contact position between the gland and the pin portion, and a separating portion is arranged on an outer side of the fixed inclined surface. The separating portion is fixed to the rotating pin, and the separating portion is provided with a movable inclined surface fitted with the gland and the fixed inclined surface.

Preferably, the rotating pin includes a U-shaped connecting portion and pin portions at both ends of the U-shaped connecting portion, and each pin portion penetrates the through hole arranged on the gland and the hole arranged on the side surface the pulling plate. Pressing portions are arranged on two side walls of the U-shaped connecting portion, and each pressing portion penetrates a slot on a side of the gland.

Preferably, a top portion of the elastic sealing sleeve is connected or adhered to the container cover through sleeving, and a bottom portion of the elastic sealing sleeve is adhesively fixed to or movably connected to the base. An inwardly bent portion is arranged on the bottom portion of the elastic sealing sleeve, and the bent portion is in close contact with an upper surface of the base.

Preferably, an exhaust hole penetrating the base is arranged on the base, and when the gland is pressed down, the exhaust hole is sealed.

Preferably, a blocking mechanism for sealing the exhaust hole is arranged on the upper side of the base, and the blocking mechanism includes a sealing plug, a blocking rod, and an elastic piece. The blocking rod penetrates a through hole arranged on the container cover, the sealing plug is fixed on an outer side of the blocking rod on a lower side of the through hole, and the elastic piece is located between the blocking rod and the upper side of the container cover. When the gland is pressed down, the gland contacts the blocking rod to move the blocking rod downwards, and the sealing plug fixed on a lower side of the blocking rod moves to an upper side of the exhaust hole to seal the exhaust hole.

Preferably, the exhaust hole includes an exhaust column with a through hole in the middle, and the exhaust column penetrates the container cover to the upper side of the container cover. A top end of the exhaust column is provided with an elastic sealing ball, and the elastic sealing ball is provided with a through hole connected to the through hole in the middle of the exhaust column. When the gland is pressed down, the gland presses the elastic sealing ball to seal the through hole of the elastic sealing ball.

Preferably, the container cover includes one or more layers of shells, gaps are provided between the layers of shells, and an accommodating groove for accommodating the gland is arranged in the middle of the container cover.

Preferably, a limiting boss is arranged on an edge of an opening of the container body, and when the container cover is sealed with the container body, the sealing ring formed by the elastic sealing sleeve abuts against a lower side surface of the limiting boss.

Preferably, the rotating pin is fixedly or detachably connected to the gland, and the rotating pin is engaged in an engaging groove arranged on the side surface of the pulling plate.

Preferably, an inclined groove communicating with the engaging groove is arranged on the side surface of the pulling plate, and the inclined groove extends to an outer side of the pulling plate.

Preferably, the base is fixedly connected or detachably connected to the pulling plate. The pulling plate is an annular structure with a communicating hole in the middle, and the communicating hole extends to the upper side of the container cover. A sealing nozzle is arranged on an outer side of the communicating hole for sealing the communicating hole. When the sealing nozzle moves up and down, the communicating hole is opened and sealed.

Preferably, a blocking portion is arranged on an inner side of the communicating hole, and a sealing hole fitted with the blocking portion is arranged on the sealing nozzle. When the sealing nozzle moves up and down, the sealing hole is sealed or unblocked by the blocking portion.

Preferably, an elastic sealing portion is arranged on a side surface of the gland, and a lower exhaust hole corresponding to the elastic sealing portion is arranged on the pulling plate. When the container body is closed, the elastic sealing portion abuts against the lower exhaust hole and the elastic sealing portion seals the lower exhaust hole. When the gland is opened, the lower exhaust hole communicates with the outside.

Preferably, a fixing ring is arranged on an outer side of the container cover, and a rotating ring is arranged on an outer side of the gland. After the gland is pressed down to close the container body, the rotating ring is close to the fixing ring, and the rotating ring and the fixing ring are overlapped.

Beneficial effects provided by the disclosure include the following.

1. By rotating the gland on the upper side of the container cover, the base is directly controlled to move up and down, such that the shape of the elastic sealing sleeve is changed, and the container body and the container cover are thus connected and sealed. Such a process may be easily performed, quick opening and closing are realized, and a good sealing effect is also provided.
2. The rotating pin is fixed by a detachable connection or fixed by a separating portion provided with a moving inclined surface, and in this way, overall installation and removal may be conveniently executed, and cleaning and using may thus be conveniently performed.
3. The pulling plate is an annular structure with a communicating hole in the middle. During use, a channel may be formed, so that a user may use the container without opening the container cover and may perform selection conveniently.
4. The rotating pin is integrated with the gland, so that the overall structure is simplified. Further, the adopted engaging groove and the inclined groove structure may be conveniently assembled and may be easily disassembled and cleaned during use.

DESCRIPTION OF THE EMBODIMENTS

Figure 1:
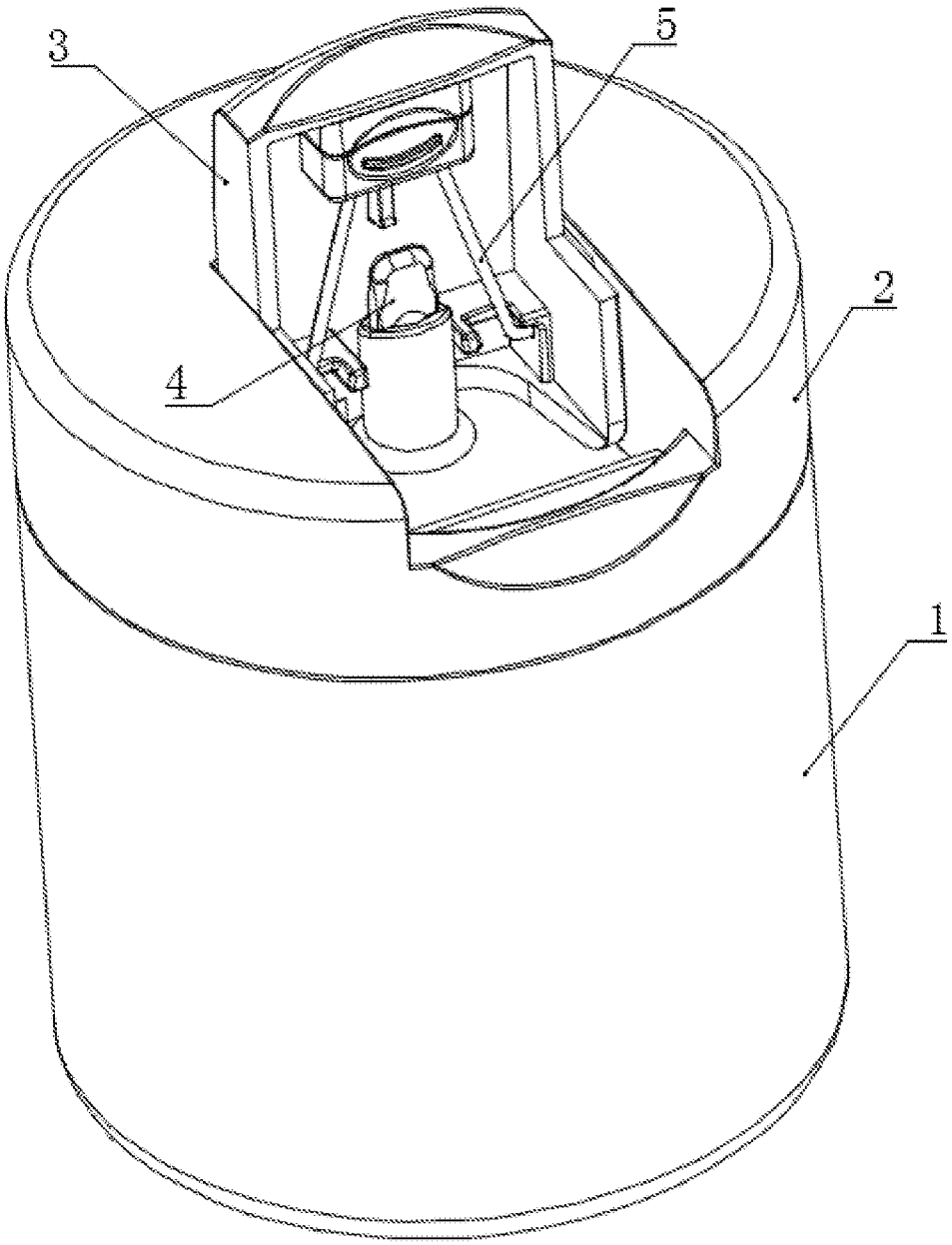
FIG. 1 is a schematic view of a structure of a container in the first example according to the disclosure.
Figure 2:
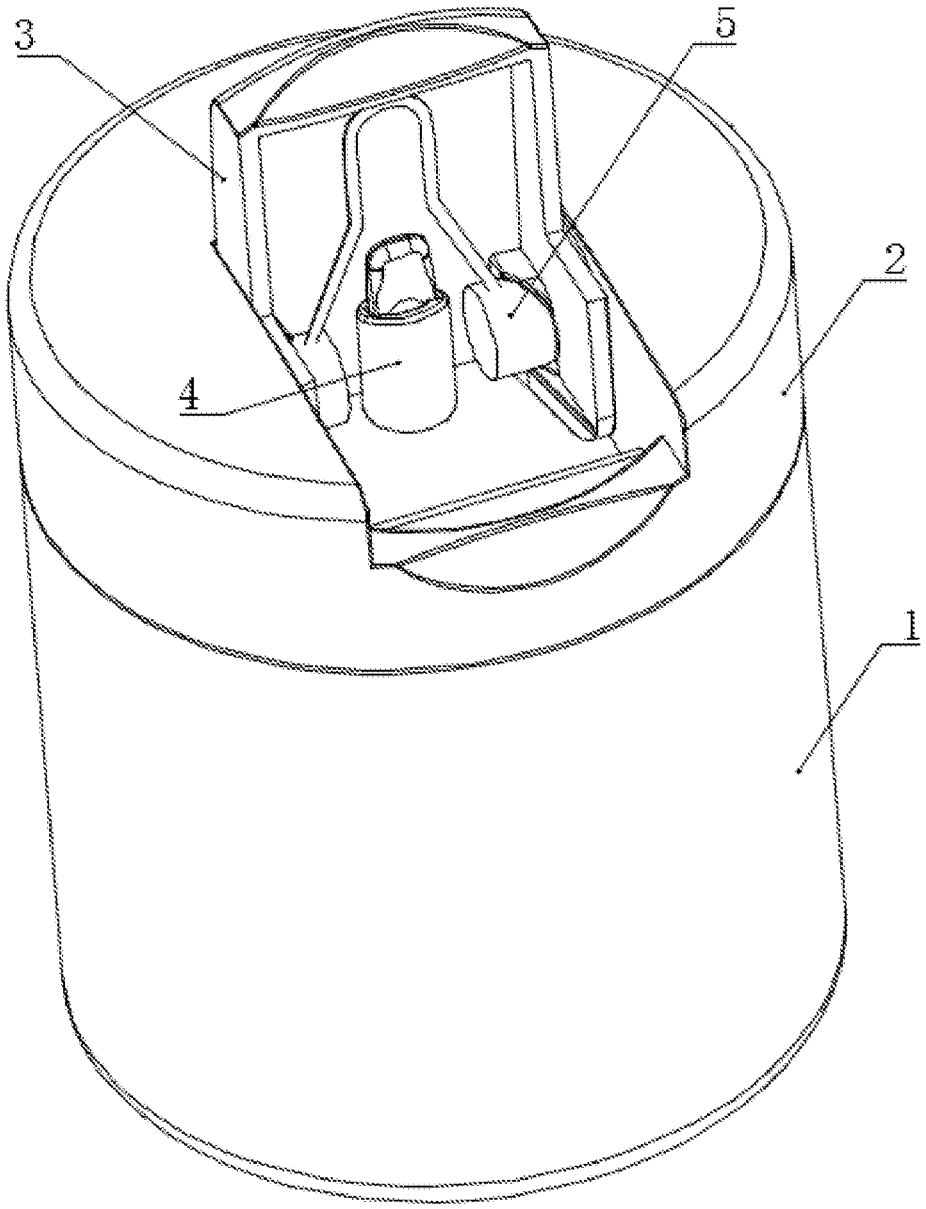
FIG. 2 is a schematic view of the structure of the container in the second example according to the disclosure.
Figure 3:
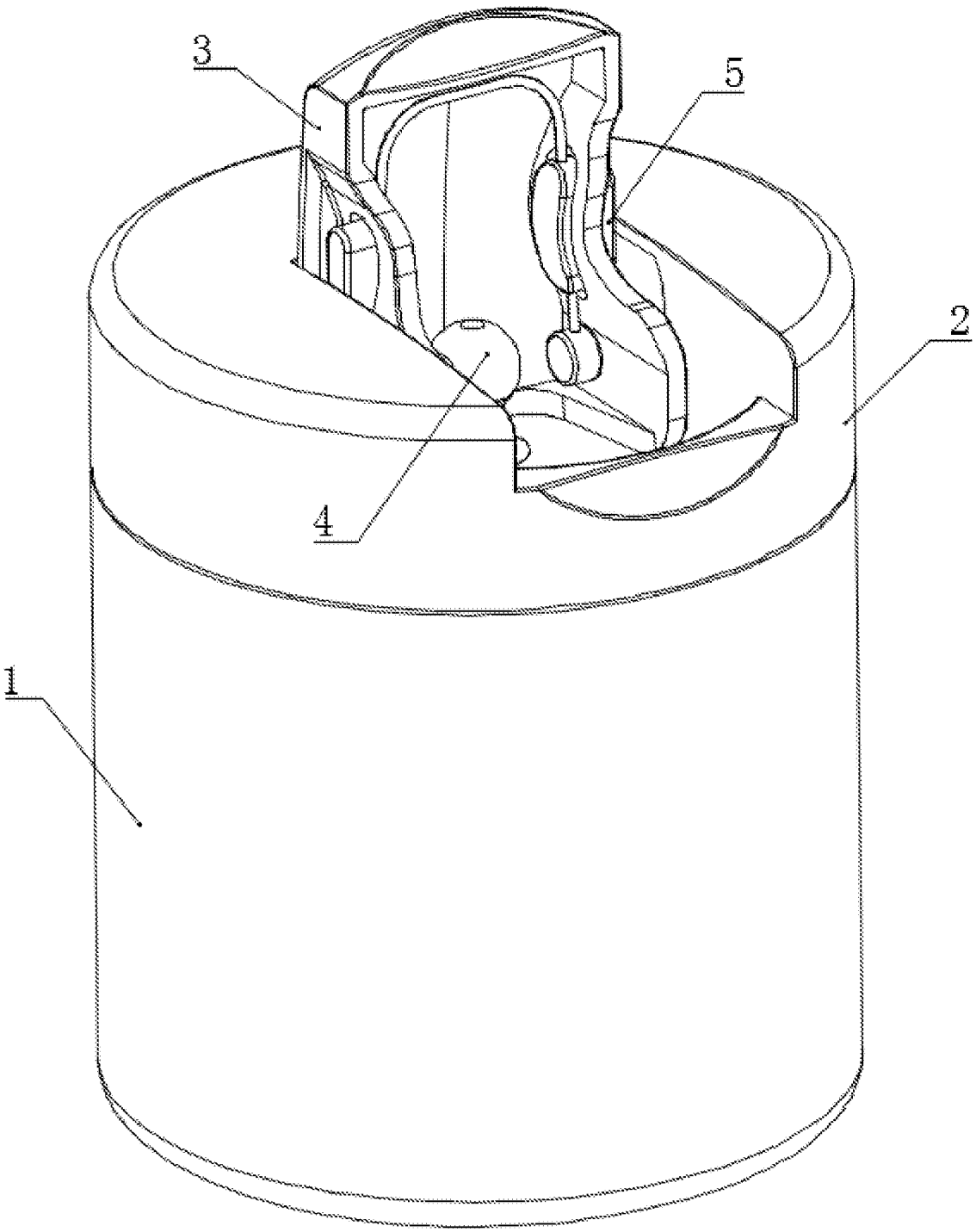
FIG. 3 is a schematic view of the structure of the container in the third example according to the disclosure.
Figure 4:
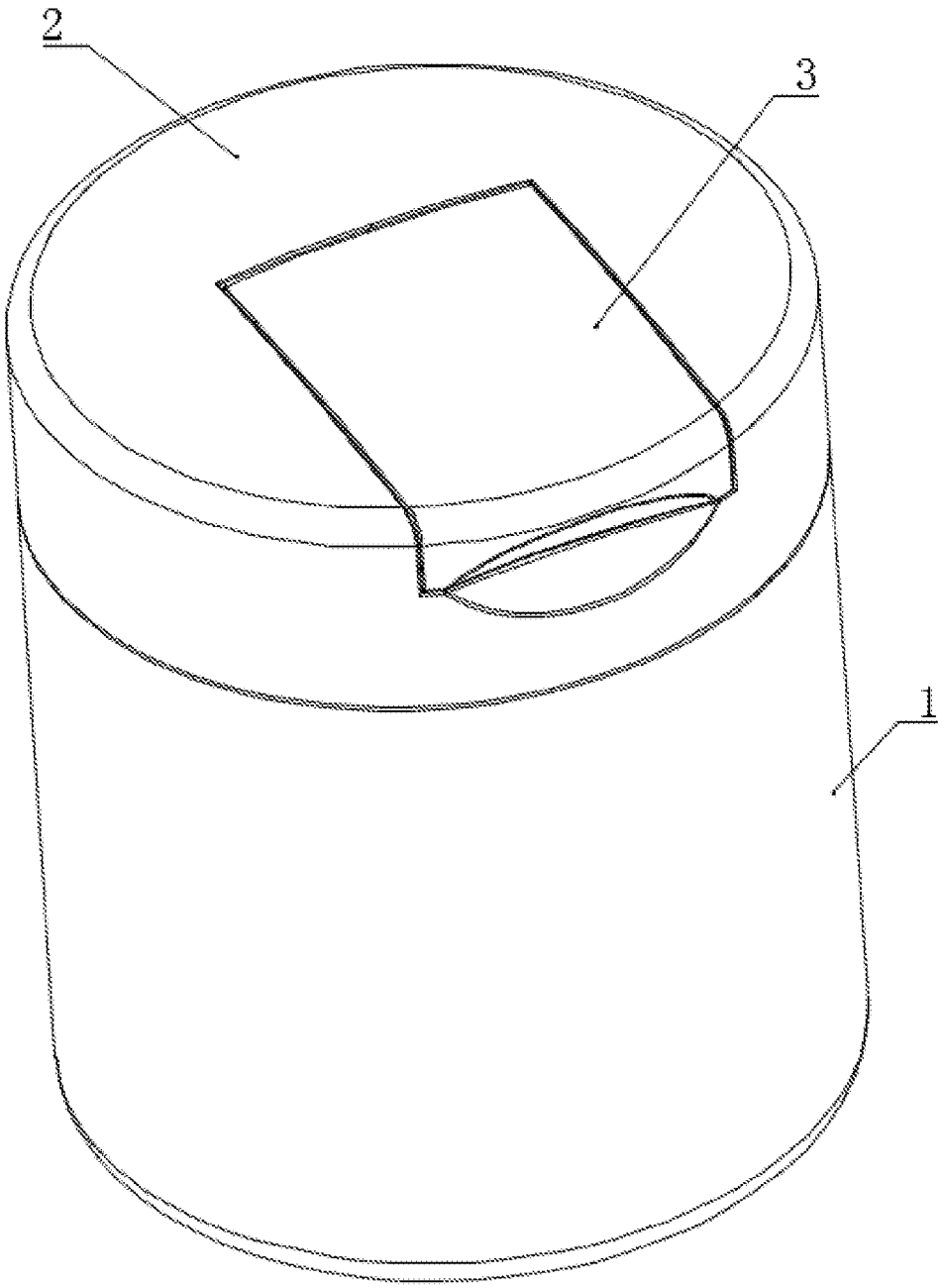
FIG. 4 is a schematic view of the structure of the container being closed according to the disclosure.
Figure 5:
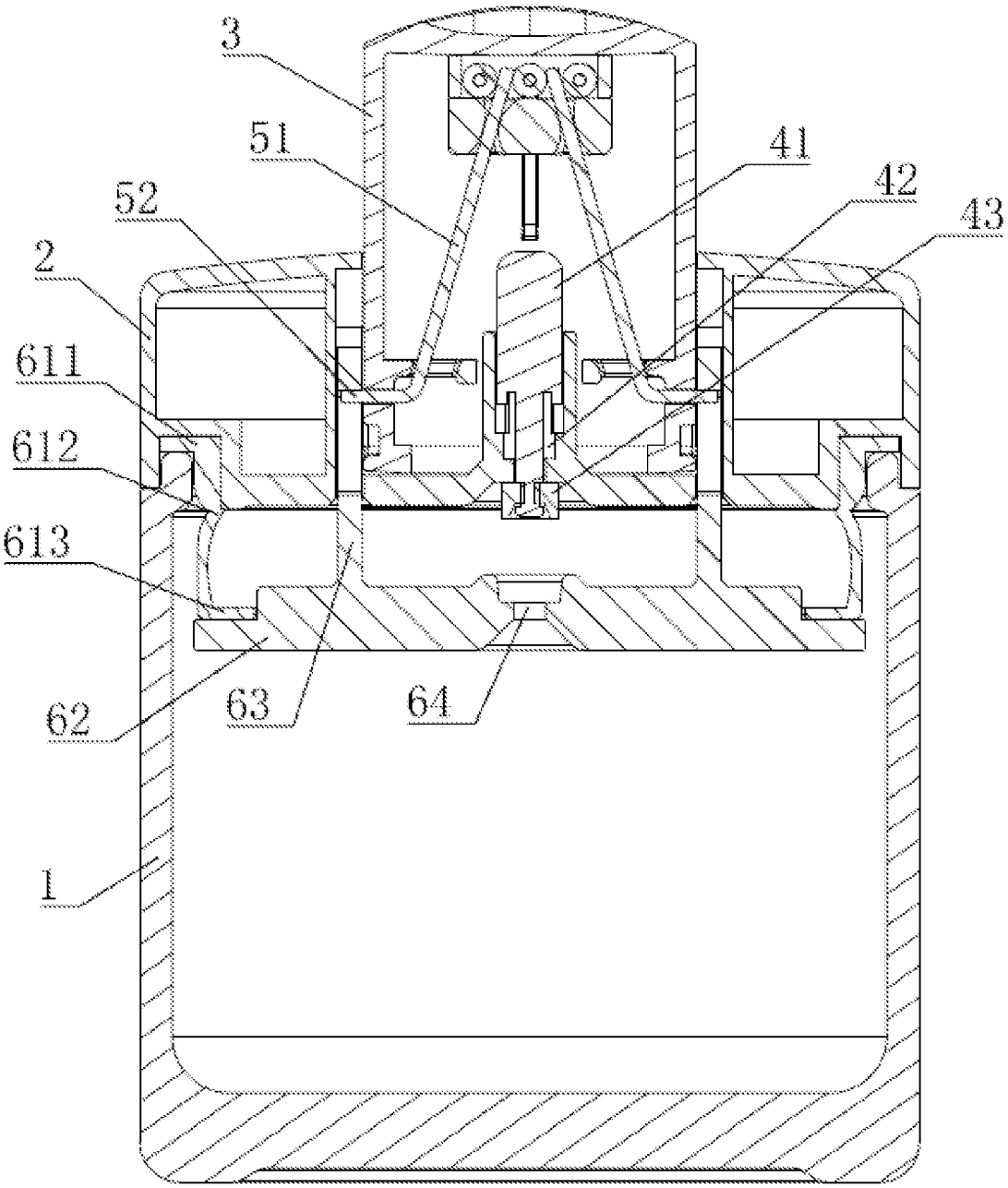
FIG. 5 is a schematic cross-sectional view of the structure of the container in the first example in an opened state according to the disclosure.

In order to make the above objects, features and advantages of the disclosure more clearly understood, the specific embodiments of the disclosure will be described in detail below with reference to the accompanying drawings. In the following description, numerous specific details are set forth in order to provide a thorough understanding of the disclosure. However, the disclosure can be implemented in many other ways than those described herein, and a person having ordinary skill in the art can make similar modifications without departing from the meaning of the disclosure. Accordingly, the disclosure is not limited by the specific examples disclosed below.

It should be noted that when a component is referred to as being "fixed to" or "disposed on" another component, it can be directly on the another component or an intervening component may be provided therebetween. When a component is considered to be "connected" to another component, it may be directly connected to the another component or an intervening component may be provided therebetween. The terms "vertical", "horizontal", "left", "right", and other similar expressions used herein are for the purpose of illustration only and do not represent the only implementation.

Unless otherwise defined, all technical and scientific terms used herein have the same meaning as commonly understood by a person having ordinary skill in the art to which this disclosure belongs. The terms used herein in the description of the disclosure are for the purpose of describing specific embodiments only, and are not intended to limit the disclosure. As used herein, the term "and/or" includes any and all combinations of one or more of the associated listed items.

As shown in FIG. 1 to FIG. 10, a container capable of being quickly opened is provided, and the container includes a container body 1 and a container cover 2. A sealing structure used for sealing the container body 1 and the container cover 2 is arranged on the container cover 2, and the sealing structure includes a base 62 on a lower side of the container cover 2. An elastic sealing sleeve 61 capable of being bent and deformed is arranged between the base 62 and the container cover 2. A pulling plate 63 penetrating the container cover 2 is arranged on an upper side of the base 62. A gland 3 is arranged on an upper side of the container cover 2, and a rotating pin 5 is arranged between the gland 3 and the pulling plate 63. When the gland 3 is opened or closed, an axis of the rotating pin 5 moves up and down, and the rotating pin 5 moves the pulling plate 63 up or down. The base 62 fixed on a lower side of the pulling plate 63 moves up and down in an axial direction of the container cover 2. The elastic sealing sleeve 61 is pressed when the base 62 moves upwards, such that the elastic sealing sleeve 61 expands in a radial direction and is bent outwards to form a sealing ring 614 between an inner wall of the container body 1 and an outer contour of the base 62, and the sealing ring 614 and an inner side surface of the container body 1 are sealed.

When in use, first, the gland 3 on the upper side of the container cover 2 is opened, that is, a first side 31 of the gland 3 is in contact with the container cover 2. The gland 3 herein is in an opened state, and the elastic sealing sleeve 61 is also in the opened state. During the process of pressing down the gland 3, a contact position between the gland 3 and the container cover 2 transitions from the first side 31 to a second side 32. Since the distance between the rotating pin 5 and the first side 31 is less than the distance between the rotating pin 5 and the second side 32, a connection position between the rotating pin 5 and the pulling plate 63 moves upwards (i.e., the distance between the connection position between the rotating pin 5 and the pulling plate 63 and the container cover 2 increases). In this way, the pulling plate 63 may move upwards, so that the base 62 located on the lower side of the pulling plate 63 may also move upwards, and the elastic sealing sleeve 61 between the base 62 and the container cover 2 may be pressed upwards to form the sealing ring 614.

When the gland 3 is opened or closed, the axis of the rotating pin 5 moves up and down, and the rotating pin 5 moves the pulling plate 63 up or down. To be specific, when the gland 3 is opened and closed, both the first side 31 and the second side 32 of the gland 3 abut against an upper side surface of the container cover 2. The distance between the rotating pin 5 and the first side 31 is less than the distance between the rotating pin 5 and the second side 32. In this way, in the opened state, the gland 3 herein is flipped outwards, the container cover 2 is opened, and the gland 3 is pressed down to seal the container cover 2 and the container body 1. In contrast, if the distance between the rotating pin 5 and the first side 31 is greater than the distance between the rotating pin 5 and the second side 32, when the gland 3 is flipped outwards, the container cover 2 and the container body 1 may be sealed, and when the container cover 3 is pressed down, the container cover 2 may be opened. In this embodiment, the former structure is adopted because this structure is convenient for the user's operation.

In order to achieve a good sealing effect, a concave limiting boss is provided on an edge of an opening of the container body 1. When the container cover 2 and the container body 1 are sealed, the sealing ring 614 formed by the elastic sealing sleeve 61 abuts against a lower side surface of the limiting boss. To be specific, when sealing is performed, the base 62 moves upwards and presses the elastic sealing sleeve 61 to form the sealing ring 614, and the outer diameter of the sealing ring 614 herein is greater than the inner diameter of the limiting boss and is less than the inner diameter of the lower side of the limiting boss of the container body 1. In this way, the formed sealing ring 614 may be engaged with the lower side of the limiting boss. Herein, in order to allow the container cover 2 to be conveniently placed in and provide an improved sealing effect, the diameter of the base 62 is slightly less than the inner diameter of the limiting boss. In this way, the container cover 2 may be placed into the container body 1, the base 62 may also form a support on the lower side of the sealing ring 614 when sealing is performed, and an improved sealing effect is thereby provided.

In order to make the base 62 move up and down during the rotation of the gland 3 and to facilitate the rotation of the gland 3, in this embodiment, the rotating pin 5 includes a pin portion 52 and a connecting portion 51. The pin portion 52 penetrates a through hole arranged on the gland 3 and a hole arranged on a side surface the pulling plate 63. One end of the connecting portion 51 is connected to the pin portion 52, and the other end is fixed through a fixing portion engaged with the inner side surface of the gland 3. Through the action of the rotating pin 5, the gland 3 and the pulling plate 63 may be relatively fixed. Herein, the distance between pin portion 52 of the rotating pin 5 and the first side 31 is less than the distance between the pin portion 52 and the second side 32. When the gland 3 is opened, the first side 31 is in contact with the container cover 2, and the gland 3 is pressed down. When the gland 3 is closed, through the arc transition between the first side and the second side, a contact surface between the gland 3 and the container cover 2 becomes the second side 32. Since the distance between pin portion 52 and the first side 31 is less than the distance between the pin portion 52 and the second side 32, when the position of the container cover 2 is not changed, the height of the pin portion 52 is raised. In this way, the pulling plate 63 fixed relative to the pin portion 52 may also rise, so that the base 62 at the bottom of the pulling plate 63 may be moved upwards, the elastic sealing sleeve 61 is pressed and deformed to form the sealing ring 614, and the sealing between the container cover 2 and the container body 1 is formed.

For the rotating pin 5, at least one is arranged. The rotating pin 5 herein is arranged in the middle of the base 62, and the pulling plate 63 is arranged corresponding to the lower side of the rotating pin 5. The base 62 may be moved by the separate pulling plate 63 and the rotating pin 5. Certainly, two pulling plates 63 may also be arranged herein. The rotating pin 5 is arranged in the middle of the two pulling plates 63, and the movement of the pulling plates 63 may also be implemented. In this embodiment, two pulling plates 63 and two rotating pins 5 are arranged, so as to ensure the stability of movement between the rotating pins 5 and the pulling plates 63 during the opening and closing process of the gland 3. Certainly, the number of the pulling plates 63 and the rotating pins 5 may also be continuously increased, for example, 3 groups, 4 groups, or more. In this embodiment, two or two groups of the rotating pins 5 and the pulling plates 63 are arranged, so that the stability of movement may be ensured, and the structure of the product may be ensured not to be excessively complicated.

The other end of the rotating pin 5 is fixed by the engaged fixing portion. When disassembly and cleaning are required, only the fixing portion is required to be disassembled, and the rotating pin 5 may then be conveniently disassembled, so that the gland 3, the pulling plate 63, the base 62, and the elastic sealing sleeve 61 may be disassembled. The other end of the rotating pin 5 may be freed and not fixed.

Figure 6:
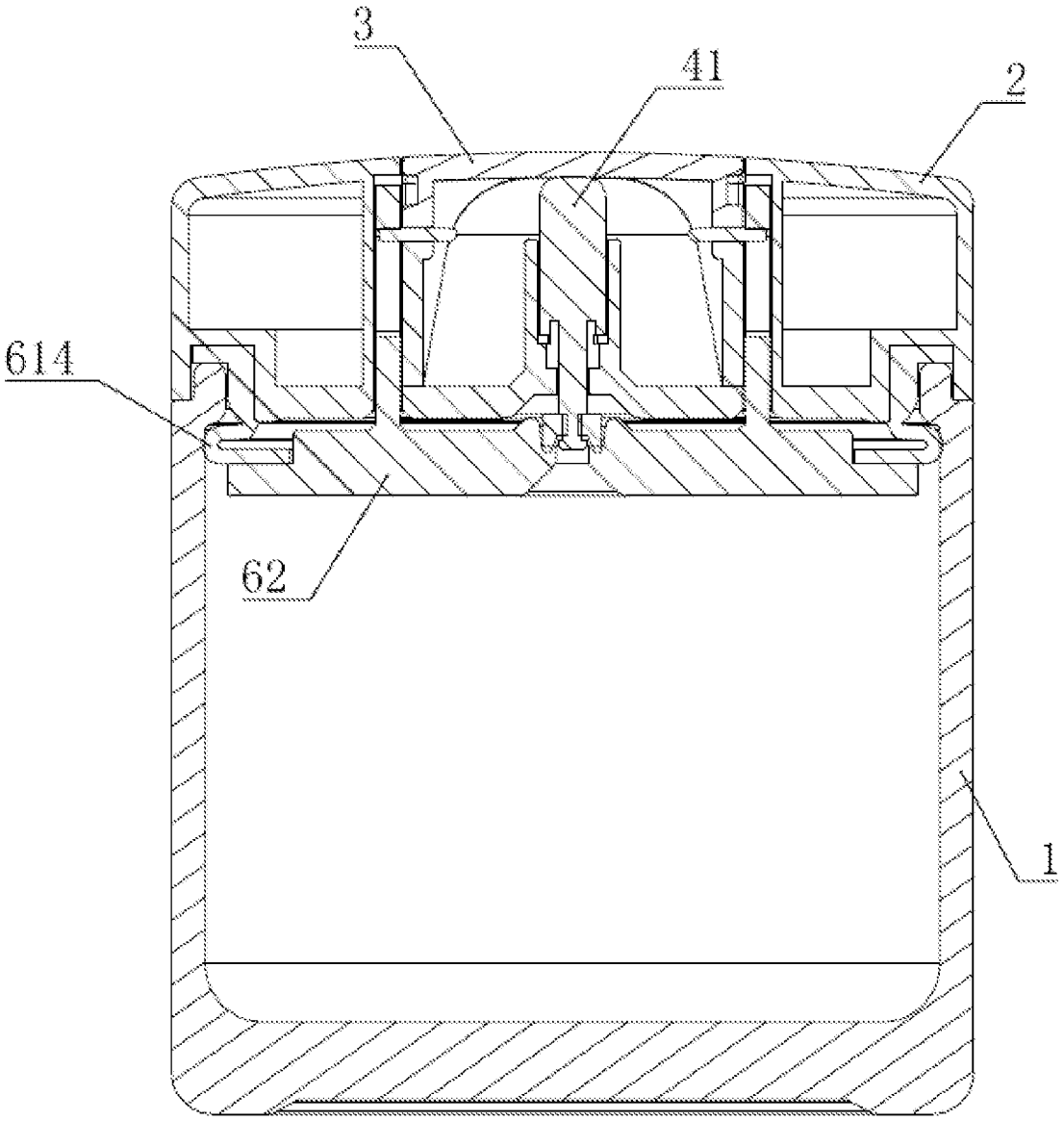
FIG. 6 is a schematic cross-sectional view of the structure of the container in the first example in a sealed state according to the disclosure.
Figure 9:
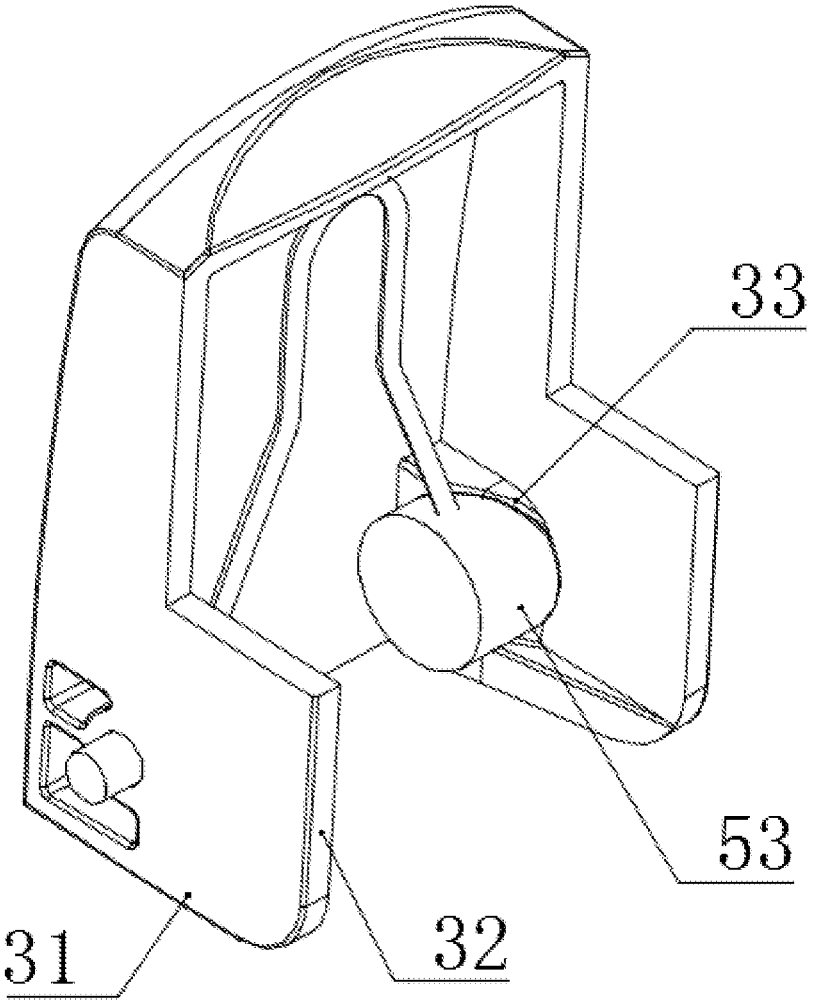
FIG. 9 is a schematic view of the structure of the gland and the rotating pin of the container in the second example according to the disclosure.

As another example of the rotating pin 5, as shown in FIG. 6 and FIG. 9, the rotating pin 5 includes a V-shaped connecting portion 51 and pin portions 52 at both ends of the V-shaped connecting portion 51, and each pin portion 52 penetrates the through hole arranged on the gland 3 and the hole arranged on the side surface the pulling plate 63. A fixed inclined surface 33 is arranged on a contact position between the gland 3 and the pin portion 52, and a separating portion is arranged on an outer side of the fixed inclined surface 33. The separating portion is fixed to the rotating pin 5, and the separating portion is provided with a moving inclined surface 53 fitted with the gland 3 and the fixed inclined surface 33. Through the action of the two inclined surfaces of the moving inclined surface 53 and the fixed inclined surface 33, the rotating pin 5 may be conveniently disassembled. When the rotating pin 5 needs to be disassembled, only the V-shaped connecting portion 51 of the rotating pin 5 is required to be pressed, and the rotating pin 5 may then be conveniently taken out, which is convenient for installation and subsequent cleaning.

Figure 7:
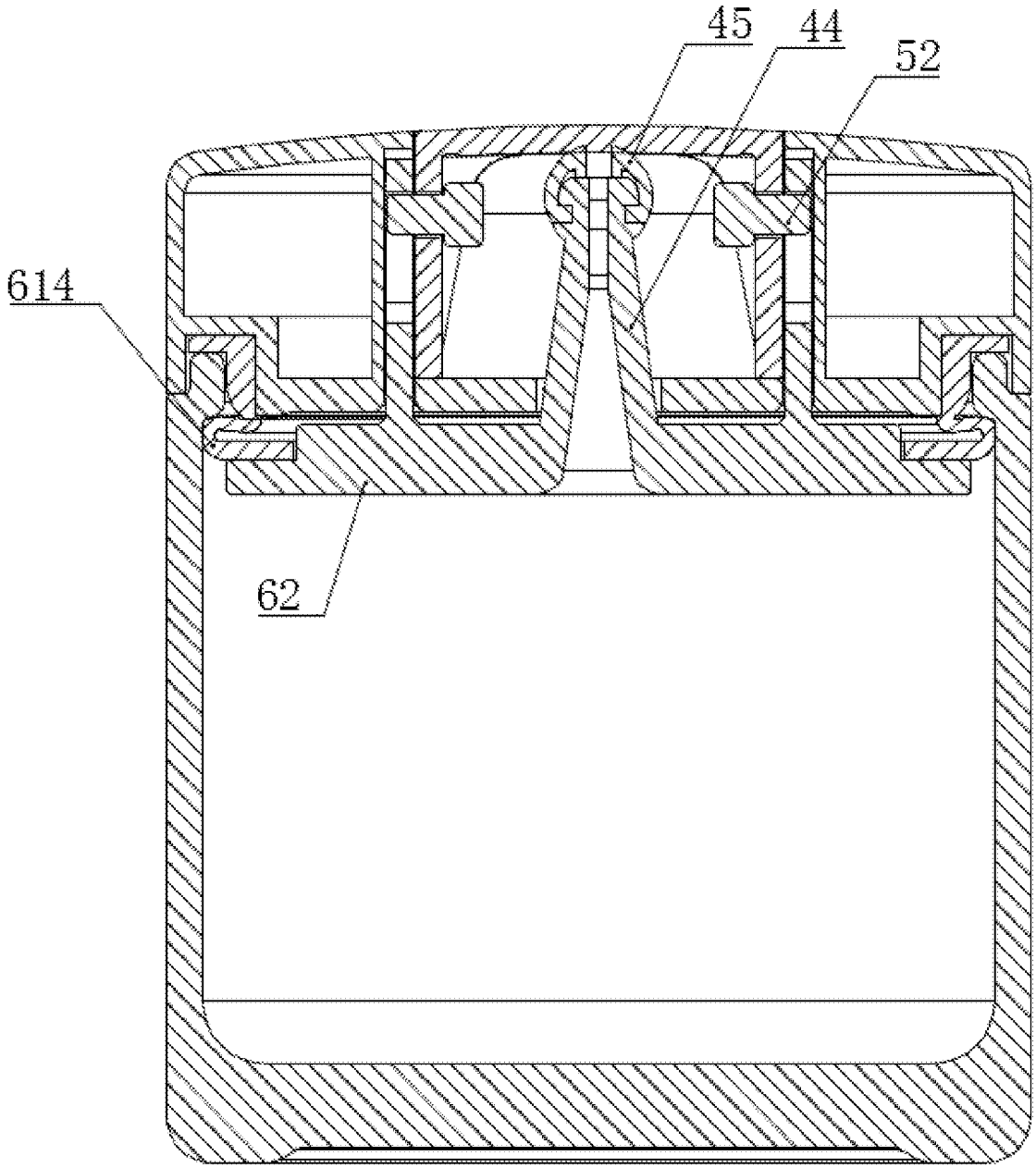
FIG. 7 is a schematic cross-sectional view of the structure of the container in the third example in the sealed state according to the disclosure.
Figure 8:
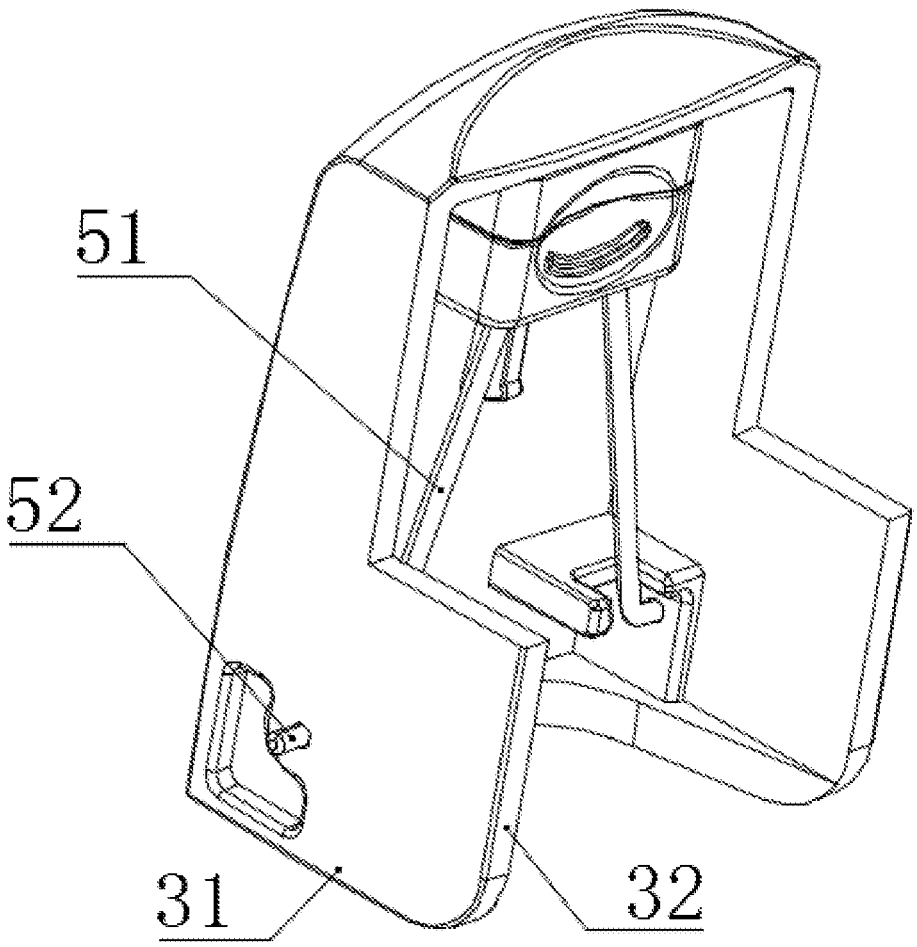
FIG. 8 is a schematic view of a structure of a gland and a rotating pin of the container in the first example according to the disclosure.
Figure 10:
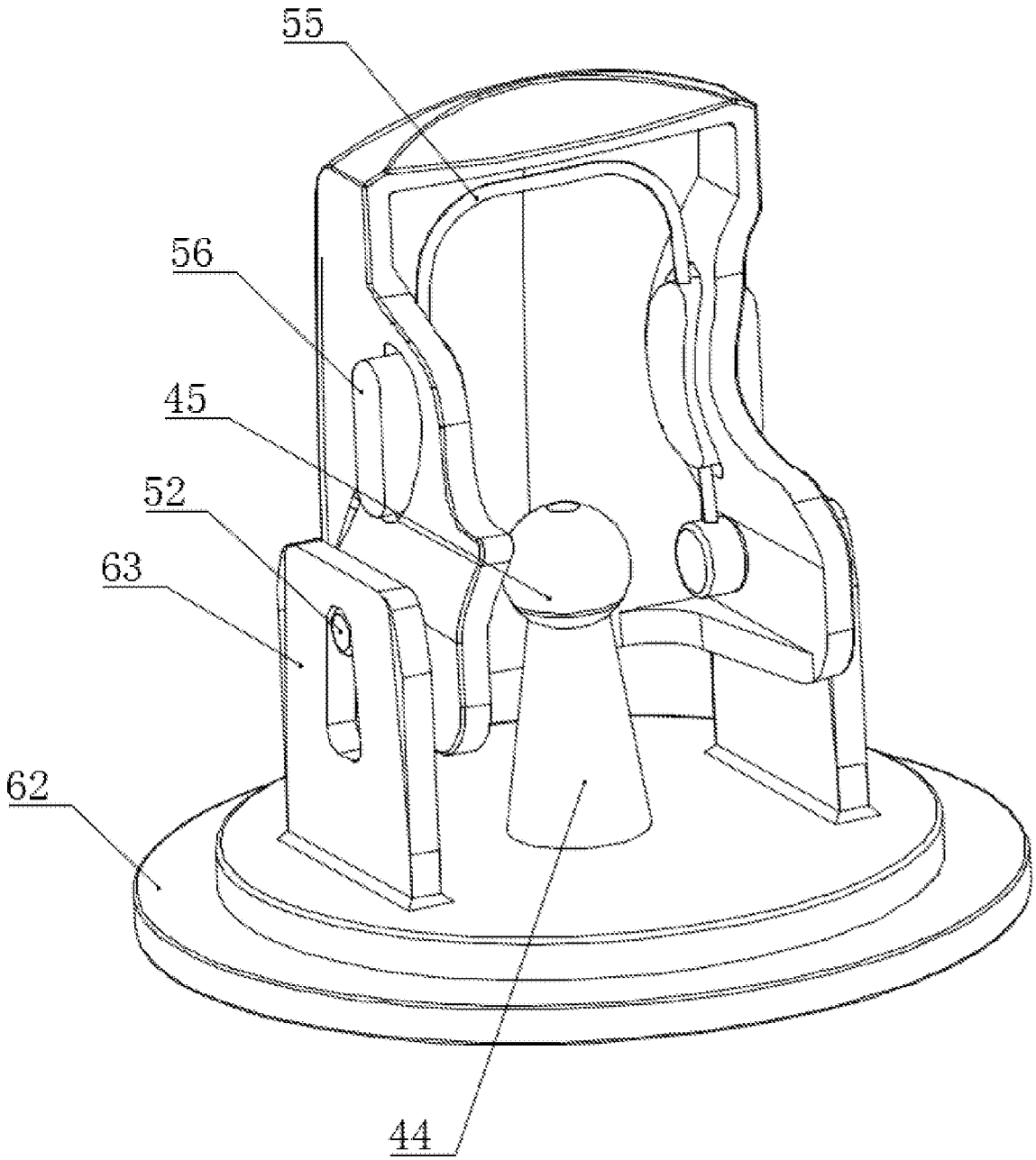
FIG. 10 is a schematic view of the structure of the gland, the rotating pin, and a base of the container in the third example according to the disclosure.
Figure 11:
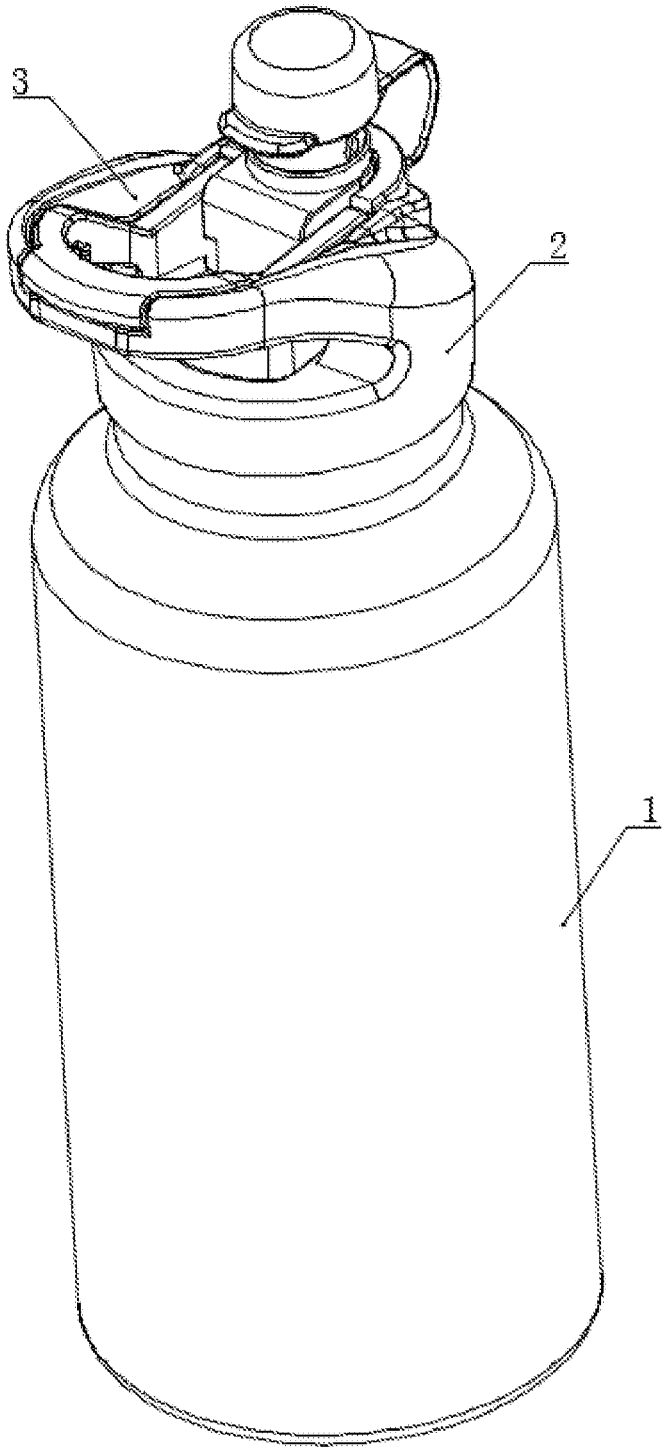
FIG. 11 is a schematic view of the overall structure of the container in the fourth example in the sealed state according to the disclosure.
Figure 12:
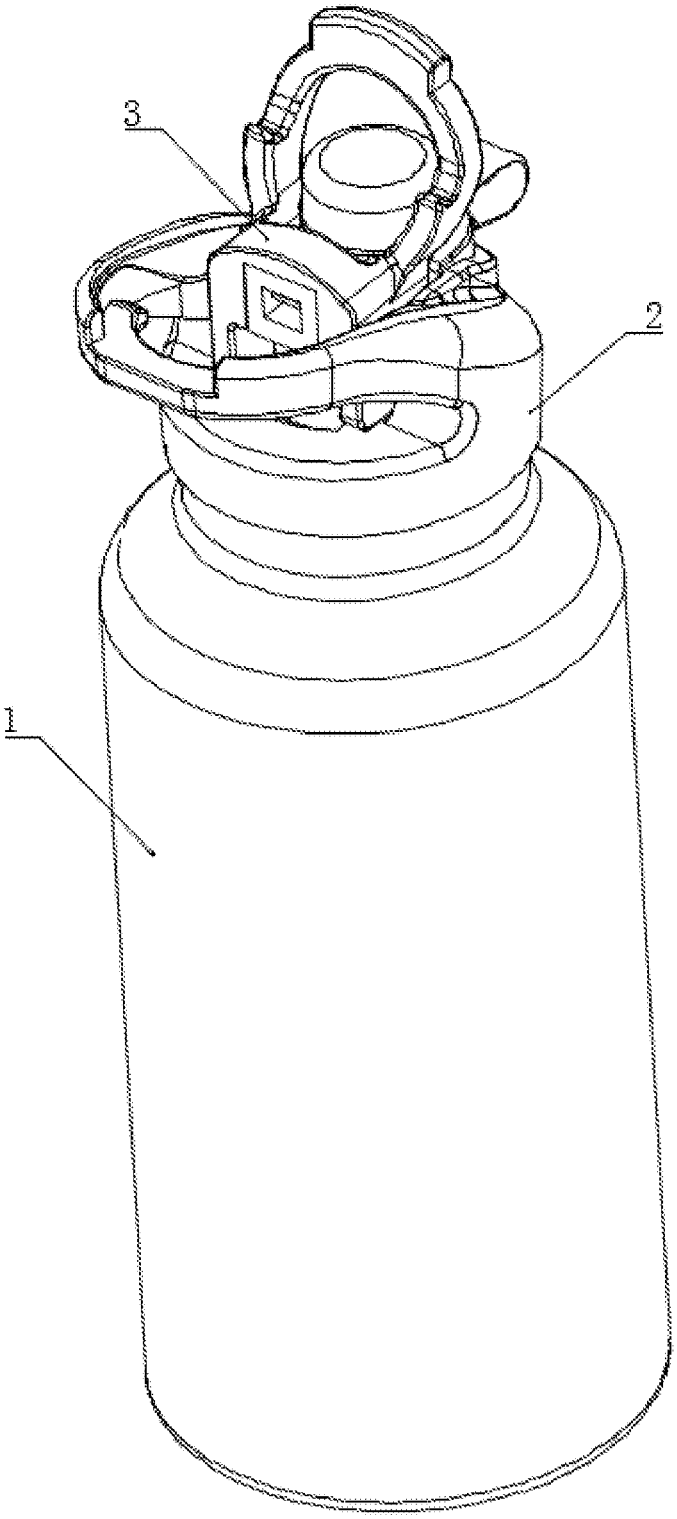
FIG. 12 is a schematic view of the overall structure of the container in the fourth example in the opened state according to the disclosure.
Figure 13:
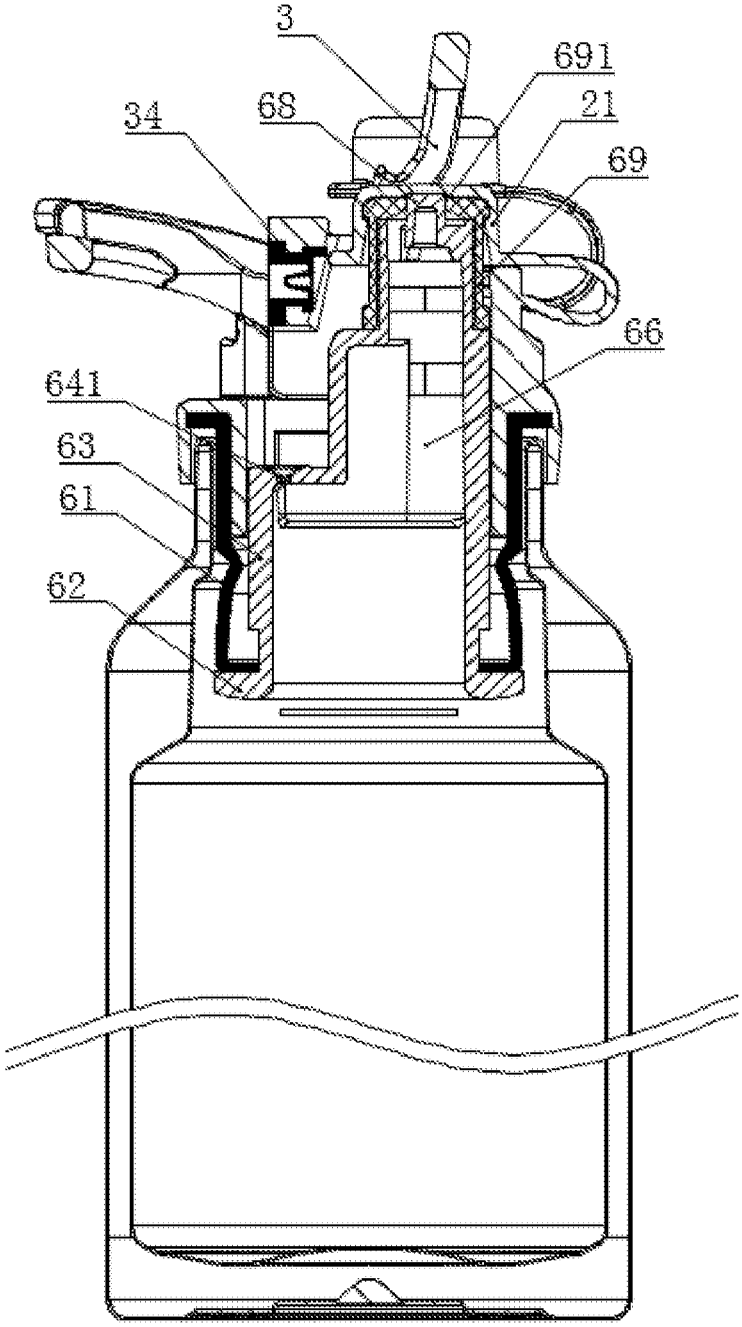
FIG. 13 is a schematic cross-sectional view of the overall structure of the container in the fourth example in the opened state according to the disclosure.
Figure 14:
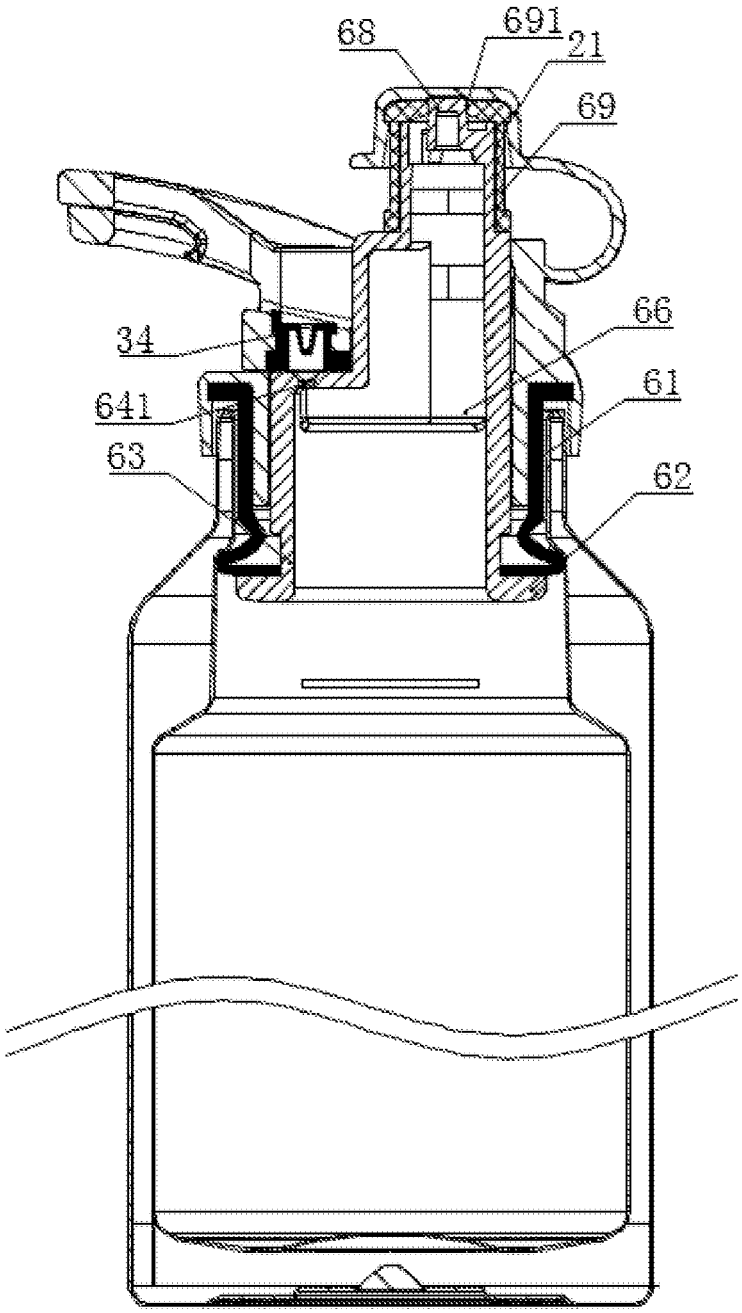
FIG. 14 is a schematic cross-sectional view of the overall structure of the container in the fourth example in the sealed state according to the disclosure.
Figure 15:
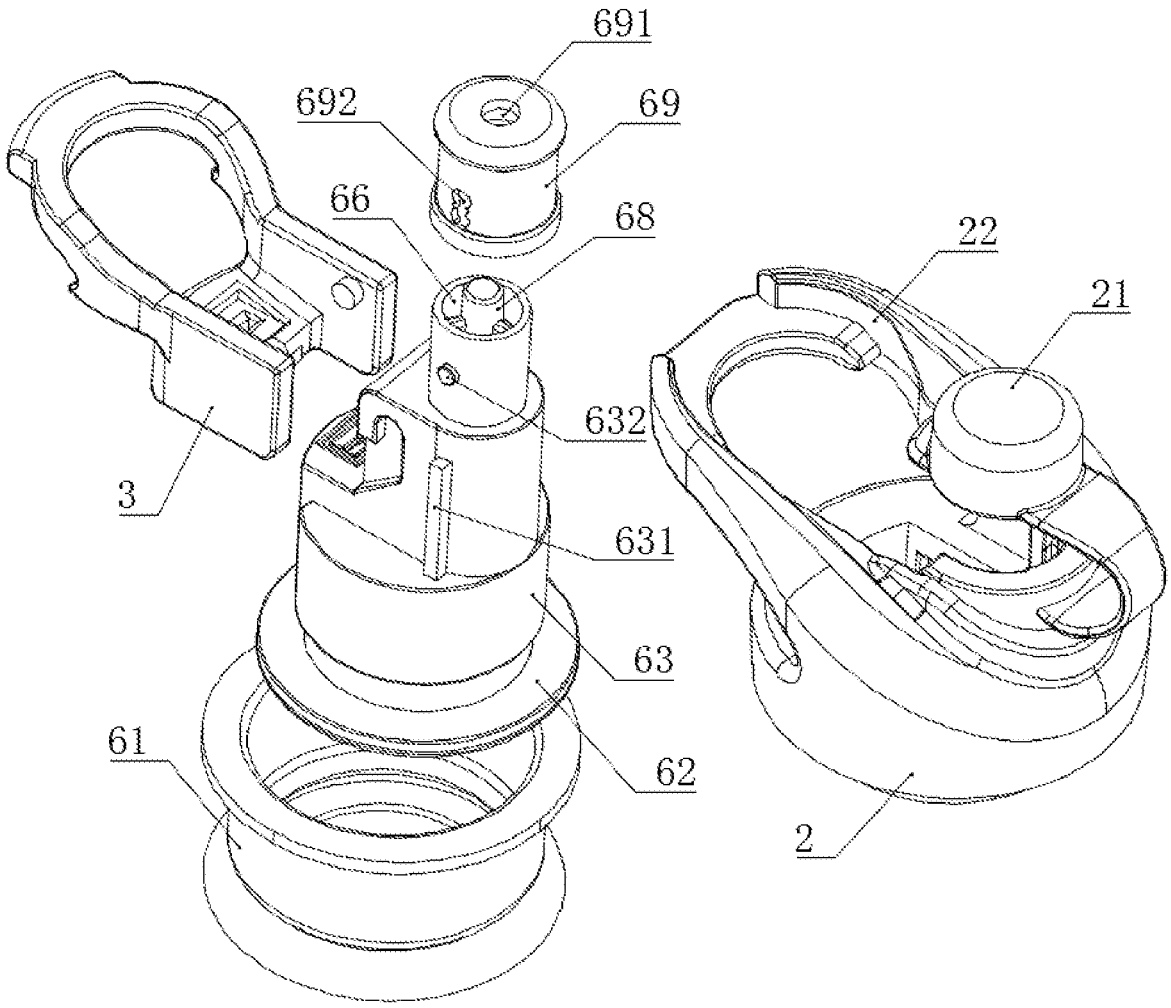
FIG. 15 is a schematic exploded view of the structure of the container in the fourth example according to the disclosure.
Figure 16:
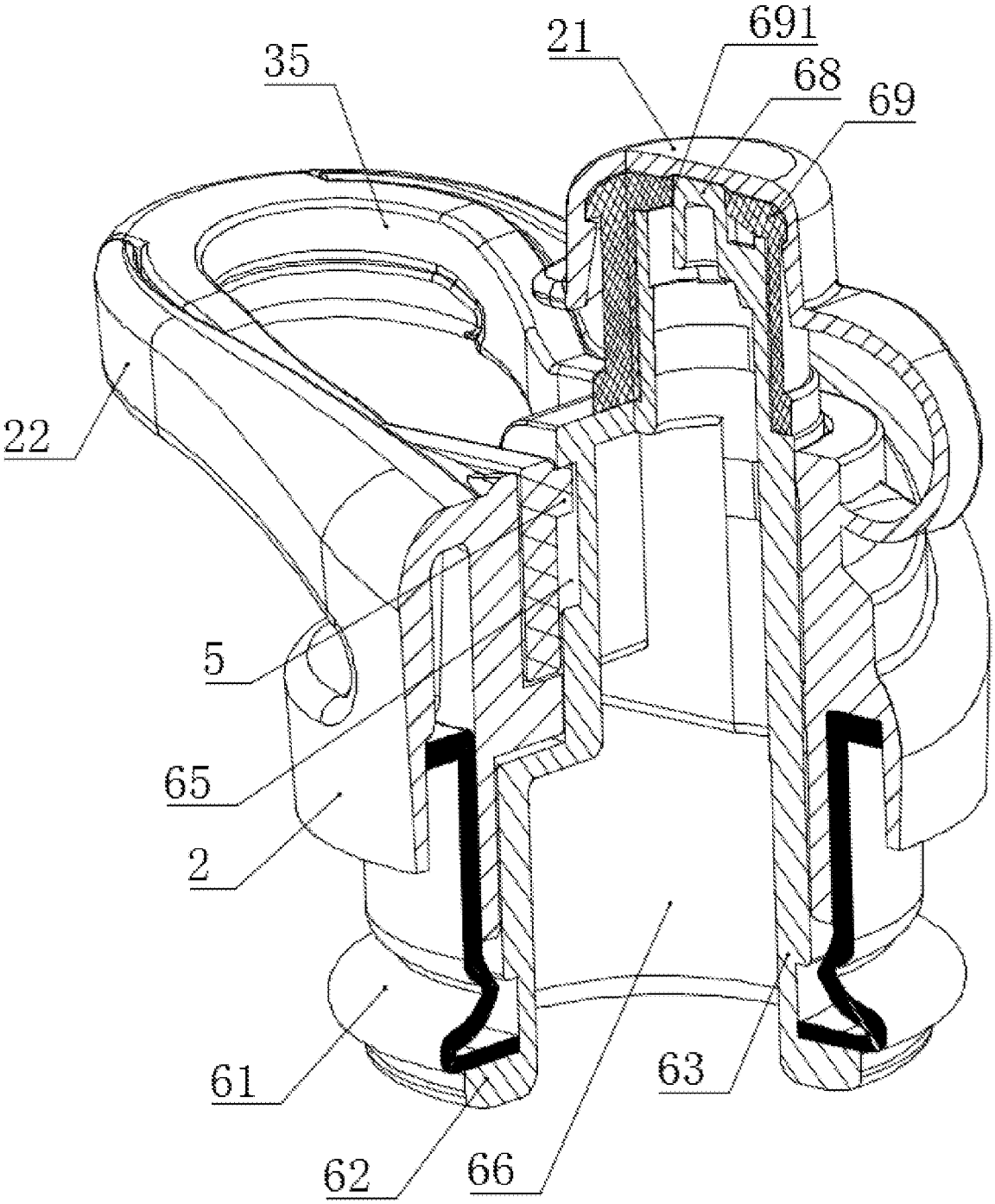
FIG. 16 is a schematic local cross-sectional view of the structure of the container in the fourth example according to the disclosure.
Figure 17:
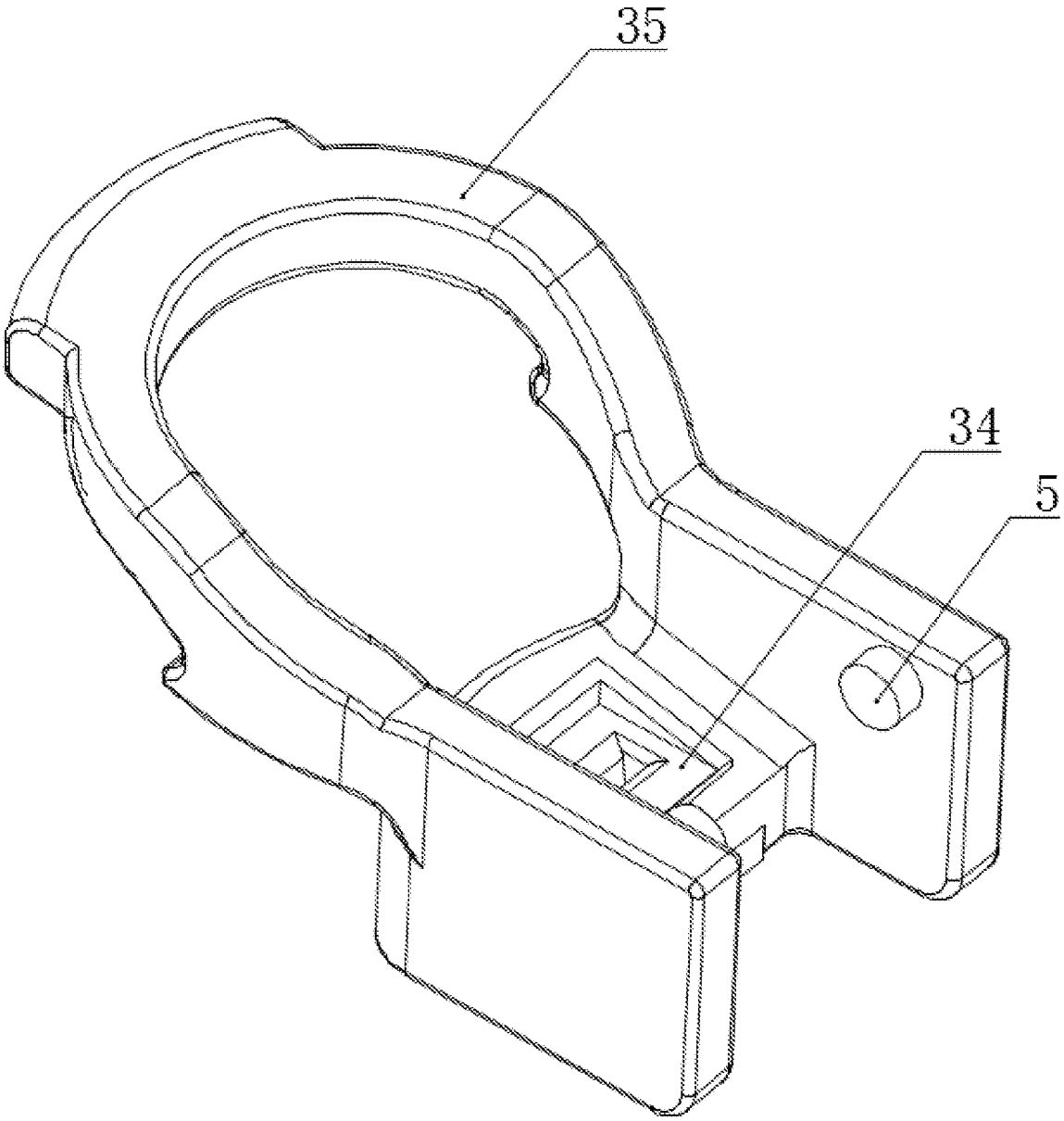
FIG. 17 is a schematic view of the structure of the gland of the container in the fourth example according to the disclosure.
Figure 18:
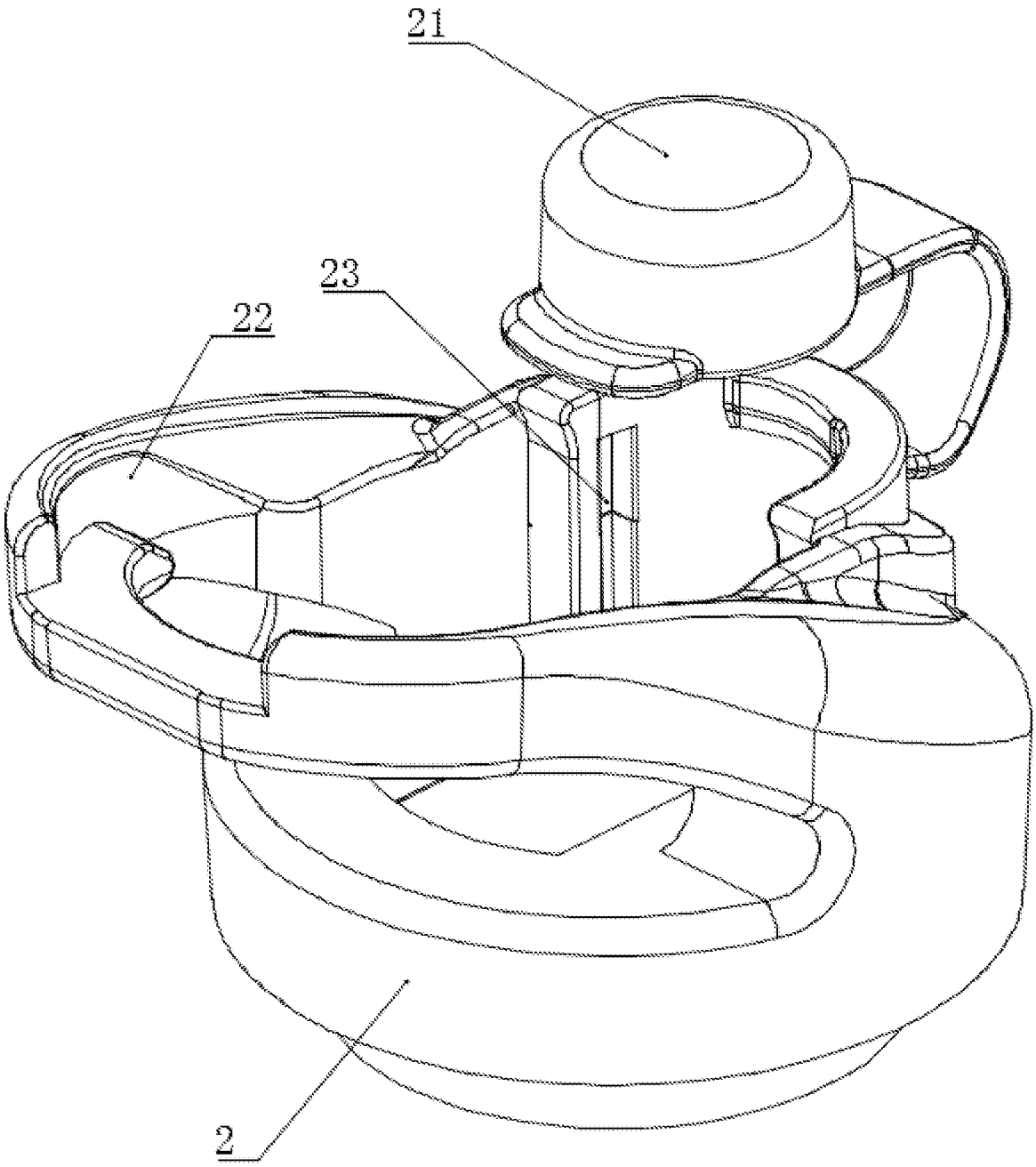
FIG. 18 is a schematic view of a structure of a container cover of the container in the fourth example according to the disclosure.
Figure 19:
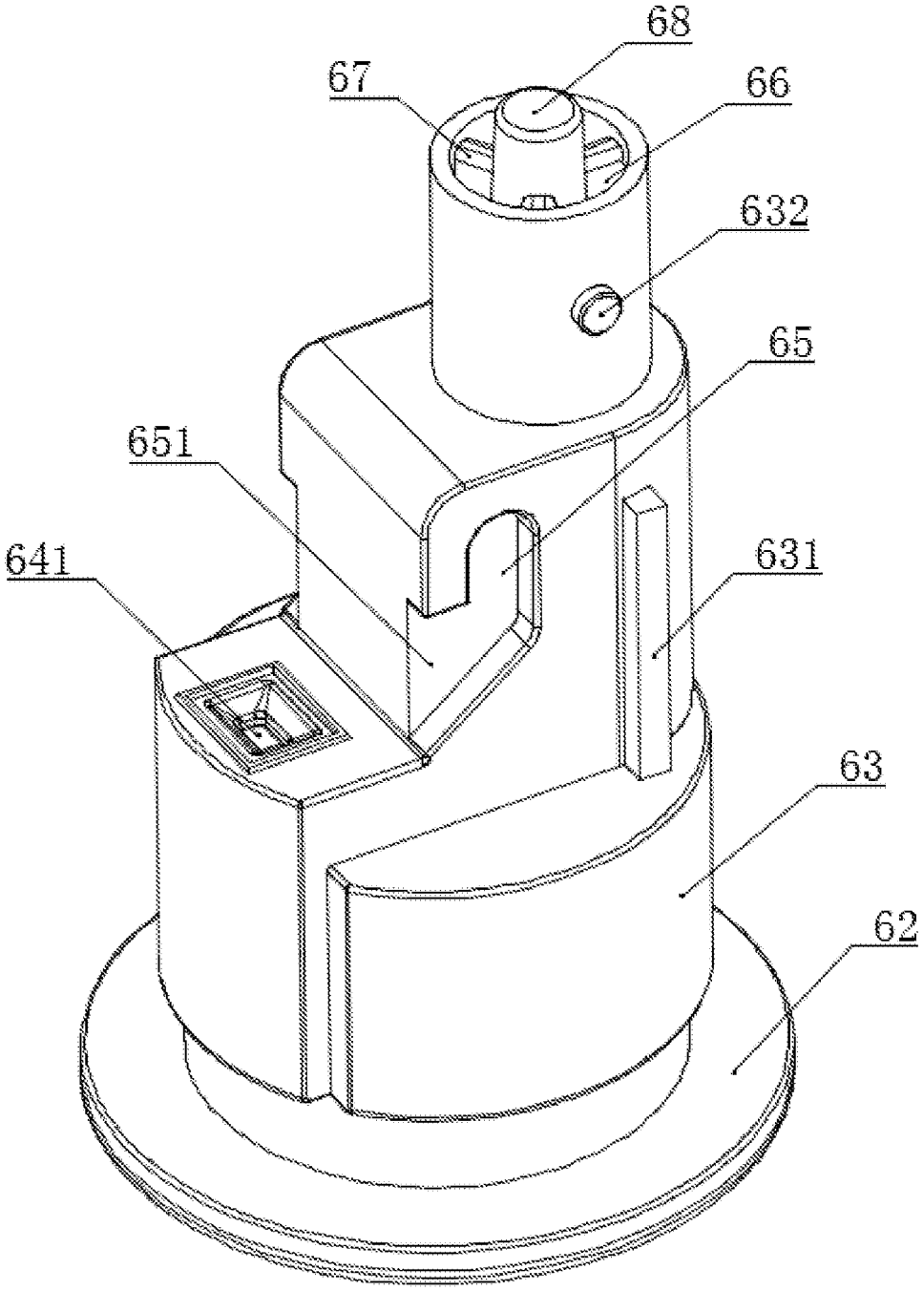
FIG. 19 is a schematic view of a structure of a pulling plate and the base of the container in the fourth example according to the disclosure.
Figure 20:
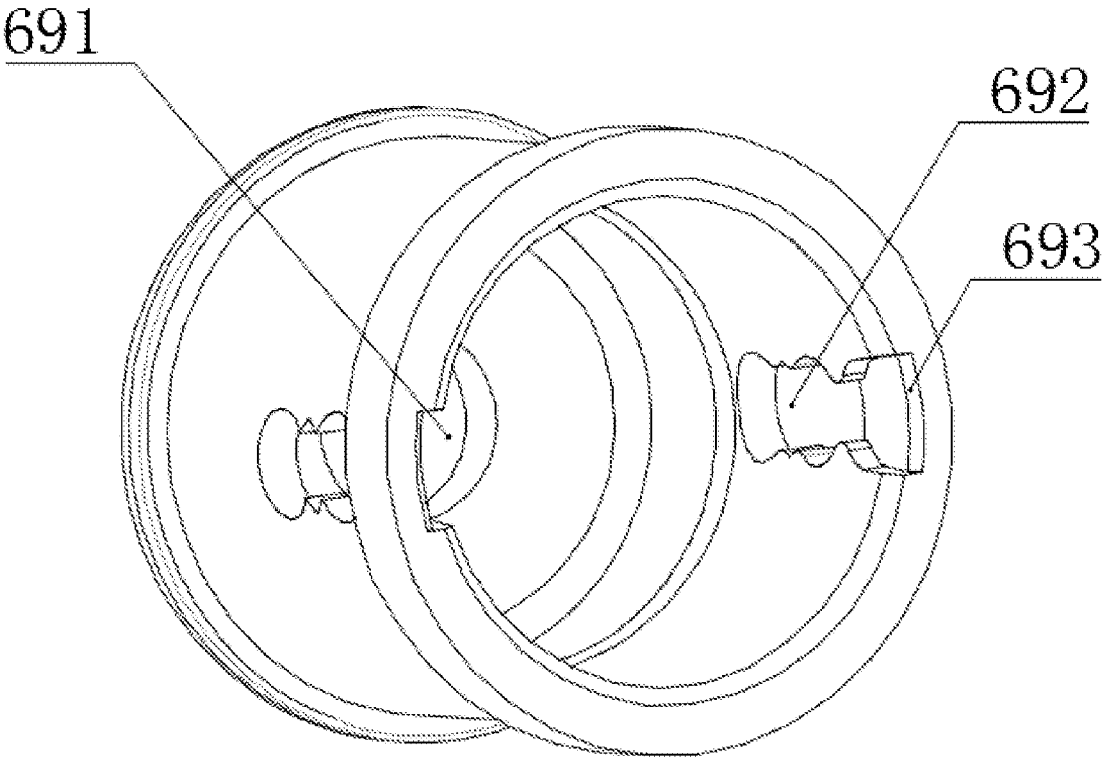
FIG. 20 is a schematic view of a structure of a sealing nozzle of the container in the fourth example according to the disclosure.

As another example of the rotating pin 5, as shown in FIG. 7 and FIG. 10, the rotating pin 5 includes a U-shaped connecting portion 55 and pin portions 52 at both ends of the U-shaped connecting portion 55, and each pin portion 52 penetrates the through hole arranged on the gland 3 and the hole arranged on the side surface the pulling plate 63. Pressing portions 56 are arranged on two side walls of the U-shaped connecting portion 55, and each pressing portion 56 penetrates a slot on a side of the gland 3. In this way, during use, the rotating pin 5 may be taken out through the pressing portions 56 on both sides, which is convenient for the user to use.

Regarding the elastic sealing sleeve 61, a top portion of the elastic sealing sleeve 61 is connected or adhered to the container cover 2 through sleeving, and a bottom portion of the elastic sealing sleeve 61 is adhesively fixed to or movably connected to the base 62. An inwardly bent portion is arranged on the bottom portion of the elastic sealing sleeve 61, and the bent portion is in close contact with an upper surface of the base 62, as long as it is ensured that the position of the elastic sealing sleeve 61 does not change during use. In this embodiment, the top portion of the elastic sealing sleeve 61 is sleeved and connected, and the bottom portion of the elastic sealing sleeve 61 is in close contact with the base 62.

To be specific, in this embodiment, in order to form a good sealing effect, an annular groove is arranged on an outer side edge of the lower side of the container cover 2. One end of the elastic sealing sleeve 61 is engaged in the annular groove, and the other end abuts against an upper side edge of the base 62. To be specific, the cross-section of the elastic sealing sleeve 61 is a "Z"-shaped structure, including an upper plane portion 611, a lower plane portion 613, and a middle inner concave portion 612. The upper plane portion 611 abuts against a bottom surface and a side surface of the annular groove of the container cover 2, the lower plane portion 613 abuts against an upper side surface of the base 62, and the middle inner concave portion 612 forms a protrusion in the axial direction. When the container cover 2 is closed with the container body 1, the limiting boss of the container body 1 is engaged in the annular groove and abuts against a lower side surface of the upper plane portion 611 of the elastic sealing sleeve 61, and effective sealing is formed. The middle inner concave portion 612 herein is concave in the axial direction to form the protrusion. When an external pressing force is applied, the elastic sealing sleeve 61 on a lower side of the middle inner concave portion 612 easily expands outwards to form the sealing ring 614, while the lower plane portion 613 of the bottom may increase the force bearing area between the elastic sealing sleeve 61 and the base 62, and stability during the pressing process is thereby ensured.

Herein, in order to allow the air in the container body 1 to be exhausted during use, an exhaust hole 64 penetrating the base 62 is arranged on the base 62, and when the gland 3 is pressed down, the exhaust hole 64 is sealed. In this way, when the container cover 2 is closed, the air in the container body 1 may be exhausted, which is convenient for the user to use.

As shown in FIG. 1, FIG. 2, FIG. 4, and FIG. 5, in order to allow the air in the container body 1 to be exhausted during use, the exhaust hole 64 penetrating the base 62 is arranged on the base 62, and a blocking mechanism 4 for sealing the exhaust hole 64 is arranged on the upper side of the base 62. Further, the blocking mechanism 4 includes a sealing plug 43, a blocking rod 41, and an elastic piece 42. The blocking rod 41 penetrates a through hole arranged on the container cover 2, the sealing plug 43 is fixed on an outer side of the blocking rod 41 on a lower side of the through hole, and the elastic piece 42 is located between the blocking rod 41 and the upper side of the container cover 2. When the gland 3 is pressed down, the gland 3 contacts the blocking rod 41 to move the blocking rod 41 downwards, and the sealing plug 43 fixed on a lower side of the blocking rod 41 moves to an upper side 64 of the exhaust hole 64 to seal the exhaust hole 64. In the initial state (the container body 1 is not sealed with the container cover 2 or the gland 3 is not pressed down), under the action of the elastic piece 42, the sealing plug 43 abuts against the lower side surface of the container cover 2. Herein, an inner portion of the container body 1 communicates with the outside through the exhaust hole 64 on the upper side of the base 62. When the gland 3 is pressed down, the lower side surface of the gland 3 contacts the blocking rod 41, and the blocking rod 41 is pressed down. The blocking rod 41 thereby moves downwards, and the sealing plug 43 fixed on the lower side of the blocking rod 41 also moves downwards, so that the exhaust hole 64 on the upper side of the base 62 may be sealed, and the container body 1 may be completely sealed. When the gland 3 is opened, under the action of the elastic piece 42, the blocking rod 41 may be restored to its original position and separated from the exhaust hole 64, so that the exhaust hole 64 is opened, the inner portion of the container body 1 communicates with the outside, and the container cover 2 may be conveniently removed in this way.

Figure 21:
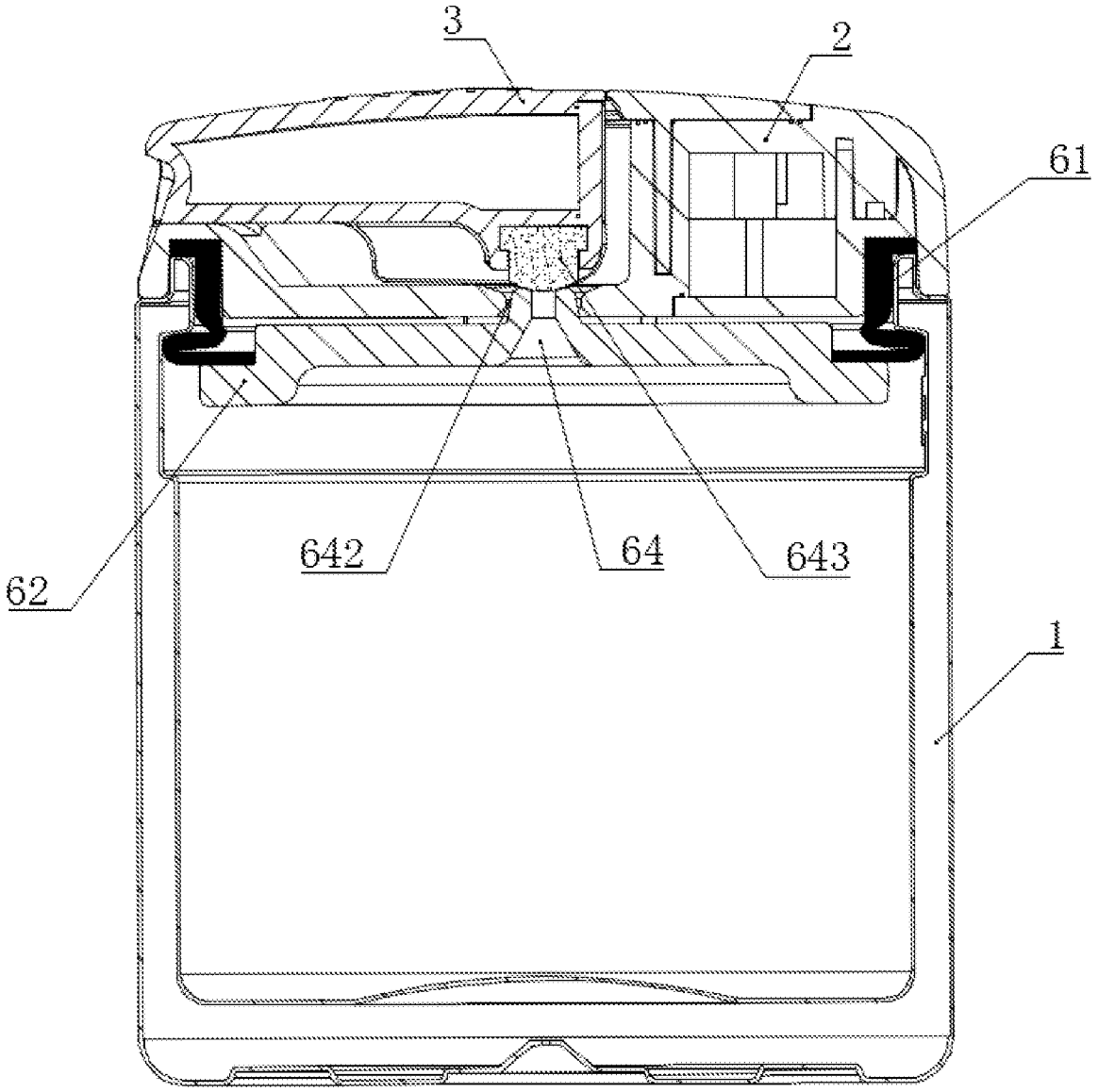
FIG. 21 is a schematic cross-sectional view of a structure an exhaust hole and a blocking mechanism of the container according to the disclosure.

Regarding another example of the exhaust hole, as shown in FIG. 21, a blocking mechanism for sealing the exhaust hole is arranged on the upper side of the base, and the blocking mechanism includes a blocking plug 643 on the lower side of the gland. Herein, the blocking mechanism is the blocking plug 643 on the lower side of the gland, and the blocking plug 643 may be fixedly or detachably connected to the gland. After the gland 3 is pressed down, the exhaust hole 64 is blocked by the blocking plug 643 on the lower side of the gland 3, and sealing is thereby completed. Certainly, in this structure, in order to ensure that the exhaust hole 64 is blocked by the blocking plug 643, a through hole 642 is arranged on the container cover, and the exhaust hole 64 penetrates the position of the through hole 642 to an upper side of the through hole 642 (penetrates a lower side wall of the container cover and into the container cover). In this way, when the base 62 moves up and down, the exhaust hole on the upper side of the base may penetrate the through hole into the container cover, and after the gland is pressed down, the blocking plug is located on the upper side of the exhaust hole to seal the exhaust hole.

Regarding another example of the exhaust hole 61, as shown in FIG. 9 and FIG. 10, the exhaust hole 64 includes an exhaust column 44 with a through hole in the middle, and the exhaust column 44 penetrates the container cover 2 to the upper side of the container cover 2. A top end of the exhaust column 44 is provided with an elastic sealing ball 45, and the elastic sealing ball 45 is provided with a through hole connected to the through hole in the middle of the exhaust column 44. When the gland 3 is pressed down, the gland 3 presses the elastic sealing ball 45 to seal the through hole of the elastic sealing ball 45.

In order to enhance the insulation effect and provide a favorable overall appearance, the container cover includes one or more layers of shells, gaps are provided between the layers of shells, and an accommodating groove for accommodating the gland is arranged in the middle of the container cover. For the container cover, a one-layer structure may be adopted, that is, the container cover is a solid structure, which is convenient for processing and production. Certainly, in order to enhance the insulation effect, the container cover may also be configured as a structure of multi-layer shells, so that a gap is provided between adjacent shells of each layer, and the overall insulation effect of the container is thereby enhanced. In this embodiment, for the convenience of production, a container cover with a two-layer shell is used. Certainly, herein, the accommodating groove for accommodating the gland 3 is arranged in the middle of the container cover 2. When the gland 3 is pressed down and the container cover 2 is sealed with the container body 1, the gland 3 is not higher than an outer side of the outermost shell of the container cover 2. In this way, the entire gland 3 may be hidden in the accommodating groove, and the overall appearance is thereby enhanced.

FIG. 11 to FIG. 20 are the fourth example of the container, and the container herein may be used as a thermos (certainly, the container may be treated as a common container to achieve quick opening). Herein, the rotating pin is fixed to the gland (fixed connection or detachable connection may be adopted), the rotating pin is engaged in an engaging groove 65 arranged on the side surface of the pulling plate, and the engaging groove 65 is arranged vertically. An inclined groove 651 communicating with the engaging groove 65 is arranged on the side surface of the pulling plate, and the inclined groove 651 extends to an outer side of the pulling plate. The rotating pin and the gland are fixed, and through engagement of the rotating pin in the engaging groove 65 on the side surface of the pulling plate, during the rotation of the gland, different side surfaces of the gland may be brought into contact with the container cover. Therefore, the pulling plate moves up and down, so that sealing is formed between the elastic sealing sleeve and the container body. Herein, the rotating pin and the gland may be integrally formed, which is convenient for production and processing. Further, since the rotating pin is not separately provided, the assembly process may be simplified and the costs may be reduced.

In this structure, the inclined groove 651 communicating with the engaging groove 65 is arranged on the side surface of the pulling plate, and an opening of the inclined groove 651 herein is inclined downwards. During assembly, the rotating pin is engaged into the engaging groove 65 from the inclined groove 651. Next, under the action of the elastic sealing sleeve, the container cover moves upwards, so that the gland is always engaged at the highest point of the engaging groove 65. In this way, during the normal rotation of the gland, the gland may not be separated from the pulling plate.

In this structure, the engaging groove 65 may be arranged vertically or inclined at a specific angle. Certainly, the inclined groove may be configured to be in an inclined state or configured to be in a horizontal state, and the rotating pin may be engaged into the engaging groove.

As for the pulling plate, in order to make it more convenient for the user to use, the pulling plate herein is an annular structure penetrating the container cover as a whole with a communicating hole 66 inside. To be specific, herein, the base is fixedly or detachably connected to the pulling plate. In this embodiment, the base and the pulling plate are integrally formed, and the pulling plate is an annular structure with the communicating hole 66 in the middle. The communicating hole 66 extends to the upper side of the container cover, and a sealing nozzle 69 is arranged on an outer side of the communicating hole 66 for sealing the communicating hole 66. When the sealing nozzle 69 moves, the communicating hole 66 is opened and sealed. A base is arranged on the outer side of the annular bottom of the communicating hole 66 of the pulling plate, and the base is annularly arranged on the outer side of the communicating hole 66. After the pulling plate is assembled with the container cover and the gland, the communicating hole 66 penetrates the container cover, and the upper and lower sides communicate with the upper and lower sides of the container cover. In this way, after the container cover and the container body are sealed under the action of the elastic sealing sleeve, the container body may also communicate with the outside through the communicating hole 66, which is convenient for the user to use. Herein, in order to allow the communicating hole 66 to be sealed when not in use, a sealing cap is arranged on the outer side of the communicating hole 66 for sealing the communicating hole 66. In this embodiment, the sealing cap is fixed on the outer side of the container cover through the connecting portion, and when not in use, the sealing cap is integrated with the container cover so that the sealing cap may not fall off. Further, for the convenience of use, the sealing nozzle 69 is arranged outside the communicating hole 66. The sealing nozzle 69 herein may seal or open the communicating hole 66 during the up and down movement, so a favorable sealing effect is provided. The sealing cap provides dust protection and is located outside the sealing nozzle 69 to prevent the sealing cap from being polluted by dust due to contact with the outside.

To be specific, in order to allow the communicating hole 66 to be sealed or opened during the upward and downward movement of the sealing nozzle 69, a blocking portion 68 is arranged inside the communicating hole 66. To be specific, in this embodiment, the blocking portion 68 is provided inside the communicating hole 66 through a connecting rib 67, and a sealing hole 691 fitted with the blocking portion 68 is arranged on the sealing nozzle 69. When the sealing nozzle 69 moves up and down, the sealing hole 691 is sealed by the sealing portion 68, or the sealing hole 691 is separated from the sealing portion 68. In this way, when the sealing nozzle 69 moves up and down, the communicating hole 66 may communicate with the outside or may be sealed. Certainly, for the convenience of use, a structure for fixing the sealing nozzle 69 is arranged on the nozzle 69. To be specific, in this embodiment, two connected circular holes 692 are arranged on the side surface of the sealing nozzle 69, and an arc-shaped transition portion is arranged at the connection of the circular holes 692. Herein, positioning cylinders 632 corresponding to the circular holes 692 are arranged on the outer side of the communicating hole 66 (pulling plate), and the positioning cylinders 632 may be engaged into the circular holes 692. When the sealing nozzle 69 moves up and down, the positioning cylinders 632 are engaged with different circular holes 692, so that the sealing nozzle 69 is in different positions, and that the communicating hole 66 may communicate with the outside or may be sealed. In this structure, in order to allow the sealing nozzle 69 to be conveniently installed, an insertion groove 693 is provided on the lower side of each circular hole 692 of the sealing nozzle 69. One side of the insertion groove 693 communicates with the circular hole 692, and the other side extends to the lowermost side of the sealing nozzle 69. When in use, the insertion groove 693 is aligned with the positioning cylinder 632, and the sealing nozzle 69 is inserted into the positioning cylinder 632 from the position of the insertion groove 693. Through the design of the insertion groove 693, the sealing nozzle 69 may be conveniently installed, and since the sealing cap is sleeved on the outer side of the sealing nozzle 69, the cleanliness of the sealing nozzle 69 is ensured.

In this embodiment, in order to ensure the convenience of component installation, a guide protrusion 631 is arranged on the outer side of the communicating hole 66, and a guide groove 23 is arranged at a corresponding position on the inner side of the container cover. Through the arrangement of the guide protrusion 631 and the guide groove 23, the accuracy of the positions during the assembly process of the two may be ensured. Further, a lower side of the guide groove 23 extends to the lower side of the container cover, which facilitates the insertion of the pulling plate (communicating hole 66). An upper side of the guide groove 23 does not penetrate the container cover, and after the guide protrusion 631 is inserted, it is used to position the pulling plate as a whole. In the overall installation process, first, the elastic sealing sleeve is sleeved on the upper side of the base, the container cover is then sleeved from the upper side of the pulling plate (communicating hole 66) in the direction of the guide groove 23, and the container cover is pressed down to press and deform the elastic sealing sleeve. From the upper side of the container cover, the rotating pin of the gland is inserted into the engaging groove 65 along the inclined groove 651, and the external force exerted on the container cover is then removed. Under the action of the elastic sealing sleeve, the rotating pin of the gland is engaged at the uppermost position of the engaging groove 65, and the gland is engaged on the upper side of the container cover. Further, a step is provided in the middle position of the pulling plate (communicating hole 66), and a matching step is arranged at the corresponding position of the container cover. After the two are assembled, the step surfaces of the two steps are in contact. In this way, under the action of an external force, excessive downward displacement of the container cover, excessive pressing on the elastic sealing sleeve, excessive deformation of the elastic sealing sleeve, and failure of formation of sealing in the container may be prevented from occurring.

Certainly, in this embodiment, in order to ensure that the gas inside the container body is exhausted during the process of sealing the container cover, an exhaust structure is also provided in this structure. To be specific, an elastic sealing portion 34 is arranged on the side surface of the gland, and a lower exhaust hole 641 corresponding to the elastic sealing portion 34 is arranged on the pulling plate. When the container body is closed, the elastic sealing portion 34 abuts against the lower exhaust hole 641, and the elastic sealing portion 34 seals the lower exhaust hole 641. When the gland is opened, the lower exhaust hole 641 communicates with the outside.

Lastly, in this embodiment, for the sake of overall appearance and convenience for users, a fixing ring 22 is arranged on an outer side of the container cover, a rotating ring 35 is arranged on an outer side of the gland. After the gland is pressed down to close the container body, the rotating ring 35 is close to the fixing ring 22, and the rotating ring 35 and the fixing ring 22 are overlapped. The arrangement of the rotating ring 35 on the outer side of the gland allows the user to rotate the gland conveniently. Further, the rotating ring 35 and the fixing ring 22 provided by the two may be overlapped, which is convenient for the user to pick up the container when using it. Certainly, other shapes may also be adopted according to needs.

The technical features of the above-described embodiments may be combined arbitrarily. In order to simplify the description, not all possible combinations of the technical features in the above embodiments are described. However, as long as there is no contradiction in the combinations of these technical features, these combinations should be considered to be within the scope of the description in this specification.

The abovementioned embodiments only represent several embodiments of the disclosure, and the descriptions thereof are specific and detailed, but should not be construed as a limitation on the scope of the invention patent. It should be pointed out that for a person having ordinary skill in the art, without departing from the concept of the disclosure, several modifications and improvements can be made, which all belong to the protection scope of the disclosure. Therefore, the protection scope of the patent of the disclosure should be subject to the appended claims.

What is claimed is:

1. A container capable of being quickly opened, comprising a container body and a container cover, wherein a sealing structure is used for sealing the container body and the container cover, the sealing structure is arranged on the container cover, the sealing structure comprises a base on a lower side of the container cover, an elastic sealing sleeve capable of being bent and deformed is arranged between the base and the container cover, a pulling plate penetrating the container cover is arranged on an upper side of the base, a gland is arranged on an upper side of the container cover, at least one rotating pin is arranged between the gland and the pulling plate, when the gland is opened or closed, an axis of the at least one rotating pin moves up and down, the at least one rotating pin moves the pulling plate up or down, the base fixed on a lower side of the pulling plate moves up and down in an axial direction of the container cover, the elastic sealing sleeve is pressed when the base moves upwards, such that the elastic sealing sleeve expands in a radial direction and is bent outwards to form a sealing ring between an inner wall of the container body and an outer contour of the base, and the sealing ring and an inner side surface of the container body are sealed.

2. The container capable of being quickly opened according to claim 1, wherein the at least one rotating pin comprises at least one pin portion, and the pin portion penetrates a through hole arranged on the gland and a hole arranged on a side surface the pulling plate.

3. The container capable of being quickly opened according to claim 2, wherein the at least one rotating pin comprises a V-shaped connecting portion and pin portions at both ends of the V-shaped connecting portion, each pin portion penetrates the through hole arranged on the gland and the hole arranged on the side surface the pulling plate, a fixed inclined surface is arranged on a contact position between the gland and the pin portion, and a separating portion is arranged on an outer side of the fixed inclined surface, the separating portion is fixed to the at least one rotating pin, and the separating portion is provided with a movable inclined surface fitted with the gland and the fixed inclined surface.

4. The container capable of being quickly opened according to claim 2, wherein the at least one rotating pin comprises a U-shaped connecting portion and pin portions at both ends of the U-shaped connecting portion, each pin portion penetrates the through hole arranged on the gland and the hole arranged on the side surface of the pulling plate, pressing portions are arranged on two side walls of the U-shaped connecting portion, and each pressing portion penetrates a slot on a side of the gland.

5. The container capable of being quickly opened according to claim 2, wherein a top portion of the elastic sealing sleeve is connected or adhered to the container cover through sleeving, a bottom portion of the elastic sealing sleeve is adhesively fixed to or movably connected to the base, an inwardly bent portion is arranged on the bottom portion of the elastic sealing sleeve, and the bent portion is in close contact with an upper surface of the base.

6. The container capable of being quickly opened according to claim 1, wherein an exhaust hole penetrating the base is arranged on the base, and when the gland is pressed down, the exhaust hole is sealed.

7. The container capable of being quickly opened according to claim 6, wherein a blocking mechanism for sealing the exhaust hole is arranged on the upper side of the base, the blocking mechanism comprises a sealing plug, a blocking rod, and an elastic piece, the blocking rod penetrates a through hole arranged on the container cover, the sealing plug is fixed on an outer side of the blocking rod on a lower side of the through hole, the elastic piece is located between the blocking rod and the upper side of the container cover, and when the gland is pressed down, the gland contacts the blocking rod to move the blocking rod downwards, and the sealing plug fixed on a lower side of the blocking rod moves to an upper side of the exhaust hole to seal the exhaust hole.

8. The container capable of being quickly opened according to claim 6, wherein the exhaust hole comprises an exhaust column with a through hole in the middle, the exhaust column penetrates the container cover to the upper side of the container cover, a top end of the exhaust column is provided with an elastic sealing ball, the elastic sealing ball is provided with a through hole connected to the through hole in the middle of the exhaust column, and when the gland is pressed down, the gland presses the elastic sealing ball to seal the through hole of the elastic sealing ball.

9. The container capable of being quickly opened according to claim 1, wherein the container cover comprises one or more layers of shells, gaps are provided between the layers of shells, and an accommodating groove for accommodating the gland is arranged in the middle of the container cover.

10. The container capable of being quickly opened according to claim 1, wherein a limiting boss is arranged on an edge of an opening of the container body, and when the container cover is sealed with the container body, the sealing ring formed by the elastic sealing sleeve abuts against a lower side surface of the limiting boss.

11. The container capable of being quickly opened according to claim 2, wherein the at least one rotating pin is fixedly connected or detachably connected to the gland, and the at least one rotating pin is engaged in an engaging groove arranged on the side surface of the pulling plate.

12. The container capable of being quickly opened according to claim 11, wherein an inclined groove communicating with the engaging groove is arranged on the side surface of the pulling plate, and the inclined groove extends to an outer side of the pulling plate.

13. The container capable of being quickly opened according to claim 12, wherein the base is fixedly connected or detachably connected to the pulling plate, a communicating hole is arranged in the middle of the pulling plate, the communicating hole extends to the upper side of the container cover, a sealing nozzle is arranged on an outer side of the communicating hole for sealing the communicating hole, and when the sealing nozzle moves, the communicating hole is opened and sealed.

14. The container capable of being quickly opened according to claim 13, wherein a blocking portion is arranged on an inner side of the communicating hole, a sealing hole fitted with the blocking portion is arranged on the sealing nozzle, and when the sealing nozzle moves up and down, the sealing hole is sealed or unblocked by the blocking portion.

15. The container capable of being quickly opened according to claim 1, wherein an elastic sealing portion is arranged on the gland, a lower exhaust hole corresponding to the elastic sealing portion is arranged on the pulling plate, the elastic sealing portion abuts against the lower exhaust hole and the elastic sealing portion seals the lower exhaust hole when the container body is closed, and the lower exhaust hole communicates with the outside when the gland is opened.

16. The container capable of being quickly opened according to claim 15, wherein a fixing ring is arranged on an outer side of the container cover, a rotating ring is arranged on an outer side of the gland, and after the gland is pressed down to close the container body, the rotating ring is close to the fixing ring, and the rotating ring and the fixing ring are overlapped.

* * * * *